US011828295B2

(12) United States Patent
Hackl et al.

(10) Patent No.: US 11,828,295 B2
(45) Date of Patent: Nov. 28, 2023

(54) PRESSURE WALL FOR A FLUID PUMP AND A PUMP INCLUDING THE PRESSURE WALL

(71) Applicant: Bleckmann GmbH & Co. KG, Lamprechtshausen (AT)

(72) Inventors: Frederic Hackl, Lamprechtshausen (AT); Hubert Unterberger, Lamprechtshausen (AT); Mladen Gojkic, Lamprechtshausen (AT); Michael Ullrich, Lamprechtshausen (AT)

(73) Assignee: Bleckmann GmbH & Co. KG, Lamprechtshausen (AT)

( * ) Notice: Subject to any disclaimer, the term of this patent is extended or adjusted under 35 U.S.C. 154(b) by 0 days.

(21) Appl. No.: 17/879,690

(22) Filed: Aug. 2, 2022

(65) Prior Publication Data

US 2023/0044897 A1 Feb. 9, 2023

(30) Foreign Application Priority Data

Aug. 3, 2021 (EP) ..... 21189280.7

(51) Int. Cl.
*F04D 29/42* (2006.01)
*F04D 29/58* (2006.01)
*A47L 15/42* (2006.01)

(52) U.S. Cl.
CPC ..... *F04D 29/426* (2013.01); *A47L 15/4225* (2013.01); *F04D 29/588* (2013.01)

(58) Field of Classification Search
CPC .... F04D 29/406; F04D 29/426; F04D 29/588; A47L 15/4225; A47L 15/4285; A47L 15/4221
See application file for complete search history.

(56) References Cited

U.S. PATENT DOCUMENTS 6,779,974 B2 * 8/2004 Chien ..... F01D 1/02 415/206
7,293,958 B2 * 11/2007 Kraffzik ..... D06F 39/04 415/206

(Continued)

FOREIGN PATENT DOCUMENTS

DE 102011079887 A1 1/2013
EP 2221485 A2 * 8/2010 ..... A47L 15/4214
JP 2005-270245 A 10/2005

OTHER PUBLICATIONS

EPO; Application No. 21189280.7; Extended European Search Report dated Jan. 25, 2022.

*Primary Examiner* — Justin D Seabe
(74) *Attorney, Agent, or Firm* — Fitch, Even, Tabin & Flannery LLP

(57) ABSTRACT

The present invention relates to a pressure wall for a centrifugal pump for fluid having substantially the shape of a disc, the disc-shaped pressure wall having a central axis, the pressure wall comprising: a top surface; and a bottom surface opposing the top surface; wherein the top surface includes an inner surface section and an outer surface section, wherein the inner surface section extends radially from the central axis and is recessed to form a central recess; and wherein the outer surface section includes an inner circumferential edge portion and an outer circumferential edge portion, wherein the inner circumferential edge portion is located closer to the central axis than the outer circumferential edge portion, and wherein the outer circumferential edge portion is located higher than the inner circumferential edge portion with respect to a plane perpendicular to the central axis and passing through the inner circumferential edge portion.

12 Claims, 13 Drawing Sheets

(56) References Cited

U.S. PATENT DOCUMENTS

| | | | | |
|---|---|---|---|---|
| 7,965,928 | B2 * | 6/2011 | Eichholz | D06F 39/04 417/208 |
| 8,989,566 | B2 * | 3/2015 | Liu | F04D 29/426 392/471 |
| 9,339,167 | B2 * | 5/2016 | Kim | A47L 15/4204 |
| 9,803,653 | B2 | 10/2017 | Qi et al. | |
| 10,400,778 | B2 * | 9/2019 | Garvin | F04D 29/167 |
| 2006/0056992 | A1 * | 3/2006 | Sadler | F04D 29/426 417/354 |

* cited by examiner

PRESSURE WALL FOR A FLUID PUMP AND A PUMP INCLUDING THE PRESSURE WALL

CROSS-REFERENCE TO RELATED APPLICATION

The present application claims the benefit of priority of European Patent Application No. 21189280.7, filed on Aug. 3, 2021, the content of which is incorporated herein by reference in its entirety.

FIELD OF THE INVENTION

The present invention relates to a pressure wall for a fluid pump, in particular for a centrifugal pump for fluid, and a pump, in particular for domestic appliances such as dishwashers, including inter alia the pressure wall.

BACKGROUND ART

In the practice, it is known that, for example in domestic appliances such as dishwashers and washing machines, pumps, including at least one impeller, are used to circulate fluid in a pumping chamber. The impeller includes a top plate having a central opening and an opposing bottom plate, wherein vertical aligned blades are arranged therebetween. A rotor shaft is coupled to a central recess of the bottom plate to rotate the impeller about its rotational axis. The blades are curved in a direction perpendicular to the rotational axis of the impeller to form a C-shape, seen from a top sectional view, wherein the blades extend from the center to an outer circumference of the top plate and the bottom plate, respectively. According to this, fluid enters the impeller at the central opening, flows through an interior formed by the top plate and the bottom plate, and out in the direction perpendicular to the rotational axis of the impeller at the outer circumference of the top plate and the bottom plate. Further, a pressure wall in the form of a disc is used convey fluid in a direction to a heating unit of the pump.

DE 10 2007 025 402 A1 discloses a pressure wall for bearing a shaft, in particular of a wet rotor motor, wherein the pressure wall has a receptacle for a plain shaft bearing, which surrounds the shaft bearing on its outer circumferential surface, wherein the pressure wall has a channel to an intermediate space formed between shaft end and pressure wall and/or between shaft bearing and end shield, wherein a fluid can flow through the channel. A deflecting element is arranged, in particular integrally formed, on the end shield and/or on the receptacle and serves to deflect the fluid into the channel.

However, it is a natural aspiration to constantly increase efficiency, including that of the pumps. Furthermore, the spaces in which the pumps are installed are becoming smaller and smaller, so that there is also a need for smaller pumps and thus also for smaller pressure walls that provide at least the same flow rate to the heating unit of the pump.

It is therefore an objective of the present invention to provide a pressure wall for a fluid pump and a pump including the pressure wall with an enhanced efficiency, in particular an enhanced heating efficiency.

SUMMARY OF THE INVENTION

The following description contains specific information pertaining to implementations in the present disclosure. The present application discloses an impeller for a fluid pump, in particular for a centrifugal pump for fluid, and a pump, in particular for domestic appliances such as dishwashers, including the impeller. Further, the present application relates to a pressure wall for a fluid pump.

The objective is achieved by a pressure wall for a fluid pump according to the present invention as defined in independent claim 1 as well as by a pump, in particular for domestic appliances such as dishwashers, as defined in independent claim 15. Further developments of the present invention are defined in the dependent claims.

According to a first aspect, a pressure wall for a centrifugal pump for fluid having substantially the shape of a disc, the disc-shaped pressure wall having a central axis, the pressure wall comprising: a top surface, and a bottom surface opposing the top surface, wherein the top surface includes an inner surface section and an outer surface section, wherein the inner surface section extends radially from the central axis and is recessed to form a central recess; and wherein the outer surface section includes an inner circumferential edge portion and an outer circumferential edge portion, wherein the inner circumferential edge portion is located closer to the central axis than the outer circumferential edge portion, and wherein the outer circumferential edge portion is located higher than the inner circumferential edge portion with respect to a plane perpendicular to the central axis and passing through the inner circumferential edge portion. By doing this, fluid flow to a heating unit included in the pump is enhanced. Thus, enhancing efficiency of heating up the fluid.

In some embodiments, the pressure wall further comprises a central through hole extending at least substantially along the central axis for bearing an impeller of the pump.

In some embodiments, the height of the outer surface section measured from the inner circumferential edge portion to the outer circumferential edge portion increases in the direction perpendicular to the central axis of the pressure wall, preferably increases steadily.

In some embodiments, the outer surface section is inclined towards the central axis of the pressure wall.

In some embodiments, an inclination angle formed between the outer surface section and the plane perpendicular to the central axis is larger than 0° and less than or equal to 30°, preferably less than or equal to 20°, and more preferably less than or equal to 10°.

In some embodiments, the outer surface section has a concave shape extending substantially around the entire circumference of the outer surface section. According to this, the fluid dynamics of the fluid directed to a heating unit are enhanced even more.

In some embodiments, the outer surface section further has a helical shape extending substantially in the direction of the central axis of the pressure wall.

In some embodiments, the helical shape extending substantially around the entire circumference of the outer surface section. Due to this, fluid flow in the direction of the outlet of the pump is enhanced.

In some embodiments, the helical shape of the outer surface section extends over a major portion of the circumference of the outer surface section with the remaining portion connecting the end portions of the outer surface section together.

In some embodiments, the pressure wall is a deep-drawn part. According to this, pressure wall is easy to manufacture, while keeping producing costs low. The pressure wall is preferably made of a mold-able plastic part, such as a polypropylene (PP), a thermoset resin, a printed part, etc.

In some embodiments, the pressure wall is made of a metal, preferably a corrosion-resistant metal, such as stainless steel or high-alloy steel.

In some embodiments, the bottom surface is recessed to form a chamber for receiving a rotor of the motor of the pump.

In some embodiments, the bottom surface comprises an outer circumferential edge to connect with a casing portion of the pump.

In some embodiments, the central recess has a cylindrical shape which substantially matches the outer contour of an impeller.

According to a second aspect, a pump, in particular for domestic appliances such as dishwashers, comprising: a pumping chamber including a central axial fluid inlet and a tangential fluid outlet, a heating unit for heating the fluid, an impeller for conveying fluid, wherein the impeller rotating within the pumping chamber, a motor for driving the impeller, and a pressure wall according to any of claims 1 to 14 for deflecting the fluid flowing out of the impeller towards the heating unit of the pump.

According to a further aspect, an impeller for a centrifugal pump for fluid comprises a lower pump plate having at least one coupling section configured to be coupled to a rotor shaft for driving the impeller about its rotational axis, an upper pump plate opposing the lower pump plate and having a central opening for providing an inlet for a fluid to be pumped, and a plurality of blades arranged between the lower pump plate and the upper pump plate, wherein the upper pump plate and the lower pump plate both have an outer circumference forming an outlet for the pumped fluid, wherein the fluid flows in a fluid flow direction from the fluid inlet through a pump interior formed by the lower and the upper pump plate, and out at the fluid outlet, wherein each of the blades has a suction surface, a pressure surface opposing the suction surface, side edges and a longitudinal axis extending at least substantially in fluid flow direction: a first longitudinal side edge of each blade being attached to the upper pump plate, a second longitudinal side edge of each blade opposing the first longitudinal side edge, and being attached to the lower pump plate, an inflow side edge of each blade being arranged at least substantially in the opposite direction of the fluid flow, and an outflow side edge opposing the inflow side edge, and being arranged at least substantially in the direction of the fluid flow; wherein the suction surface of each blade has at least partially a convex curvature extending at least substantially in the direction of the rotational axis of the impeller. Due to the convex curvature of the suction surface of each blade, the fluid dynamics of the fluid flow flowing through the impeller can be enhanced. Thus, efficiency of the impeller improves, consequently. Further, the outflow side edge of each blade may be arranged substantially perpendicular to the lower pump plate and the upper pump plate.

According to another aspect, an impeller for a fluid pump comprises a lower pump plate having at least one coupling section configured to be coupled to a rotor shaft for driving the impeller about its rotational axis, an upper pump plate opposing the lower pump plate and having a central opening for providing an inlet for a fluid to be pumped, and a plurality of blades arranged between the lower pump plate and the upper pump plate, wherein the upper pump plate and the lower pump plate both have an outer circumference forming an outlet for the pumped fluid, wherein the fluid flows in a fluid flow direction from the fluid inlet through a pump interior formed by the lower and the upper pump plate, and out at the fluid outlet, wherein each of the blades has a suction surface, a pressure surface opposing the suction surface, side edges and a longitudinal axis extending at least substantially in fluid flow direction: a first longitudinal side edge of each blade being attached to the upper pump plate, a second longitudinal side edge of each blade opposing the first longitudinal side edge, and being attached to the lower pump plate, an inflow side edge of each blade being arranged at least substantially in the opposite direction of the fluid flow, and an outflow side edge opposing the inflow side edge, and being arranged at least substantially in the direction of the fluid flow, wherein an angle formed between the outflow side edge and the lower pump plate is an acute angle. Further, the acute angle between the outflow side edge and the lower pump plate may face towards the rotational direction of the impeller. An acute angle is an angle that measures between 90° and 0°, meaning it is smaller than a right angle (an "L" shape) but has at least some space between the two lines that form it. Due to the inclination or rather oblique alignment of each of the blades, the fluid dynamics of the fluid flow flowing through the impeller can be enhanced. Thus, efficiency of the impeller improves, consequently.

Additionally, the suction surface of each blade may have at least partially a convex curvature extending at least substantially in the direction of the rotational axis of the impeller. As a result, efficiency of the impeller may be enhanced even further.

In some embodiments, the pressure surface of each blade has at least partially a concave curvature extending at least substantially in the direction of the rotational axis of the impeller. According to this, the fluid dynamics of the fluid flow flowing through the impeller may be enhanced. In particular, this can reduce turbulence in the impeller. According to a further embodiment, the suction surface of each blade has at least partially a concave shape, wherein the pressure surface of each blade has at least partially a convex shape.

In some embodiments, the convex and/or concave curvatures extend substantially along the entire surface of each blade in direction of the longitudinal axis extending at least substantially in fluid flow direction.

Moreover, in some embodiments, the inflow side edge and/or the outflow side edge of each blade is curved substantially in the direction of the rotational axis of the impeller.

In some embodiments, each blade is torqued in the direction perpendicular to the rotational axis of the impeller. Further, instead of the convex and/or concave curvatures of each blade, each blade may only be torqued. Independently of the angle formed between the outflow side edge of each blade and the lower pump plate of the impeller. Each blade may further have the shape of a helix extending substantially along the longitudinal axis of the respective blade.

In some embodiments, an upper section of each blade, formed between the first longitudinal side edge and the inflow side edge, extends at least partially into the central opening of the upper pump plate, preferably having a substantially frustum shape with a rounded outer circumference.

Besides, in some embodiments, the height of each blade measured from the first longitudinal side edge to the second longitudinal side edge decreases in the direction perpendicular to the rotational axis of the impeller, preferably decreases steadily.

Furthermore, the slope of the first longitudinal side edge and/or the second longitudinal side edge may change at any point, even a turning point in the path of the first longitudinal side edge and/or the second longitudinal side edge is possible.

Furthermore, each blade may terminate at the outer circumference of the lower pump plate and the upper pump plate. According to a further feature, each blade may terminate at a predefined distance just before the outer circumference of the lower pump plate and the upper pump plate, i.e. the fluid outlet.

In some embodiments, the outer circumference of the lower pump plate is larger than the outer circumference of the upper pump plate. This increases the outlet surface of the fluid outlet.

In some embodiments, the inflow side edge is arranged in an acute angle to the lower pump plate, wherein the inflow side edge and the outflow side edge preferably have the identical acute angle with respect to the lower pump plate.

In some embodiments, the lower pump plate comprises a cross-section which corresponds to a hat-like trapezoid with rounded edges, and wherein the hat-like trapezoid with rounded edges preferably corresponds to a bell-like trapezoid with rounded edges.

In some embodiments, the upper pump plate comprises a cross-section which decreases from the inside to the outside, preferably decreases steadily.

In some embodiments, each blade comprises a cross-section which has a wave-form, and wherein the wave-form includes at least one upward portion and one downward portion.

According to a further aspect, a pump, in particular for domestic appliances such as dishwashers, comprises: a pumping chamber including a central axial fluid inlet and a tangential fluid outlet, an impeller for conveying fluid, wherein the impeller rotating within the pumping chamber, and a motor including a rotor shaft, wherein the rotor shaft is attached to the at least one coupling section of the impeller. The pump may be a centrifugal pump for fluid.

The pump may further include a heating unit for heating up the fluid flowing through the pump.

Further, each blade of the impeller may be circularly arranged in regular intervals from each other between the lower pump plate and the upper pump plate. Preferably, three to nine blades are arranged between the lower pump plate and the upper pump plate, further preferably four to seven blades, and further more preferably five to six blades.

Moreover, the impeller may further comprise a plurality of sub-blades arranged between the lower pump plate and the upper pump plate, and extending from the outer circumference of the lower pump plate and the upper pump plate to the interior formed by the lower pump plate and the upper pump plate, wherein the radial extension of the sub-blades is less than the radial extension of the blades. Sub-blades increase the pressure inside the impeller and thereby enhancing efficiency of a pump including the impeller. Each sub-blade opposing two blades and is associated to a respective blade, wherein a distance between a sub-blade to an associated blade may be different to another opposing blade. Each sub-blade may be torqued in the direction perpendicular to the rotational axis of the impeller.

Additionally, each blade and/or each sub-blade of the impeller may be tapered towards the respective inflow side edge. This, enhances fluid flow through the impeller. Further, each blade may have a fin-like shape, wherein an innermost portion of the blade, which is the first to be flowed by the fluid, corresponds to the shape of a front fin of a dolphin and the outermost portion of the blade corresponds to the shape of a back fin of a dolphin.

In an embodiment, the impeller is made of a metal. Particularly advantageously, the impeller is made of a corrosion-resistant metal, such as stainless steel or high-alloy steel. Thus, for example, it can be used in a washing machine or dishwasher, for example it is resistant not only to the water being pumped, but also to the chemically but also against the chemically and mechanically aggressive substances ingredients, especially in a dishwasher.

In some embodiments, the impeller may further comprise an upper ring plate, which is formed near the outer circumference of the upper pump plate and is attached to the outer surface of the upper pump plate of the impeller. Moreover, the impeller may additionally comprise a lower ring plate, which is formed near the outer circumference of the lower pump plate and is attached to the outer surface of the lower pump plate of the impeller. According to this, the impeller may have an upper ring plate or a lower ring plate or both. Thereby reducing the gap between a pressure bushing and/or a pressure wall, respectively.

According to a further aspect, a pressure bushing for a centrifugal pump for fluid, the pressure bushing having a substantially cylindrical shape, and comprising at least: a bottom portion, an outer side portion, and an inner side portion opposing the outer side portion and having an inner circumference surface, wherein the inner circumference surface of the inner side portion tapers at least partially towards the bottom portion of the pressure bushing. By doing this, the pressure of the fluid entering the impeller is increased. Thus, efficiency of the pump can be enhanced.

In some embodiments, the inner circumference surface of the inner side portion tapers towards the bottom portion by the method of tensile triangles. According to this, fluid dynamics of fluid flow can be enhanced. Thus, efficiency can be improved.

In some embodiments, the resulting edges of the tensile triangles are rounded. Due to this, discontinuities in the fluid flow can be suppressed.

In some embodiments, the cross-section of the inner side portion of the pressure bushing is be defined by at least one tensile triangle, preferably by at least three tensile triangles.

In some embodiments, the pressure bushing further comprises a pressure ring, wherein the pressure ring is attached to the outer circumference of the bottom portion of the pressure bushing. Due to this, it is possible to generate fluid flows which are directed towards the heating unit. Thus, the efficiency of the heating-up process can be enhanced.

In some embodiments, the pressure ring is configured to protrude over an upper pump plate of an impeller included in the pump.

In some embodiments, the outer side portion comprises an aligning element, preferably a circumferentially extending ring for at least aligning the pressure bushing to a casing portion of the pump.

In some embodiments, the pressure bushing is a moldable plastic part, such as polypropylene, a thermoset resin or a printed part. Moreover, the pressure bushing may be a deep-drawn part.

In some embodiments, the pressure bushing is made of a metal, preferably a corrosion-resistant metal, such as stainless steel or high-alloy steel.

In some embodiments, the pressure ring comprises an end portion which has a phase, wherein the phase preferably has a phase angle of approximate 45°.

In some embodiments, the pressure bushing is made of one piece.

According to another aspect, a pump, in particular for domestic appliances such as dishwashers, comprising: a pumping chamber including a central axial fluid inlet and a tangential fluid outlet, an impeller for conveying fluid, wherein the impeller rotating within the pumping chamber, a motor for driving the impeller, and a pressure bushing for conveying fluid to the impeller.

In some embodiments, the pump further comprises a heating unit for heating the fluid.

In some embodiments, a gap between the pressure bushing and the impeller is smaller than 5 mm, preferably smaller than 3 mm, and more preferably smaller than 2 mm.

In some embodiments, the gap between the pressure bushing and the impeller is substantially constant over respective opposite outer surfaces.

Further advantages and preferred embodiments of the present invention will be described in the following together with the drawings listed below. The expressions "left", "right", "below" and "above" used in the following description, are referred to the drawings in an alignment such that the reference numbers and the notation of the Figs. used can be read in normal orientation.

DETAILED DESCRIPTION

Figure 1A:
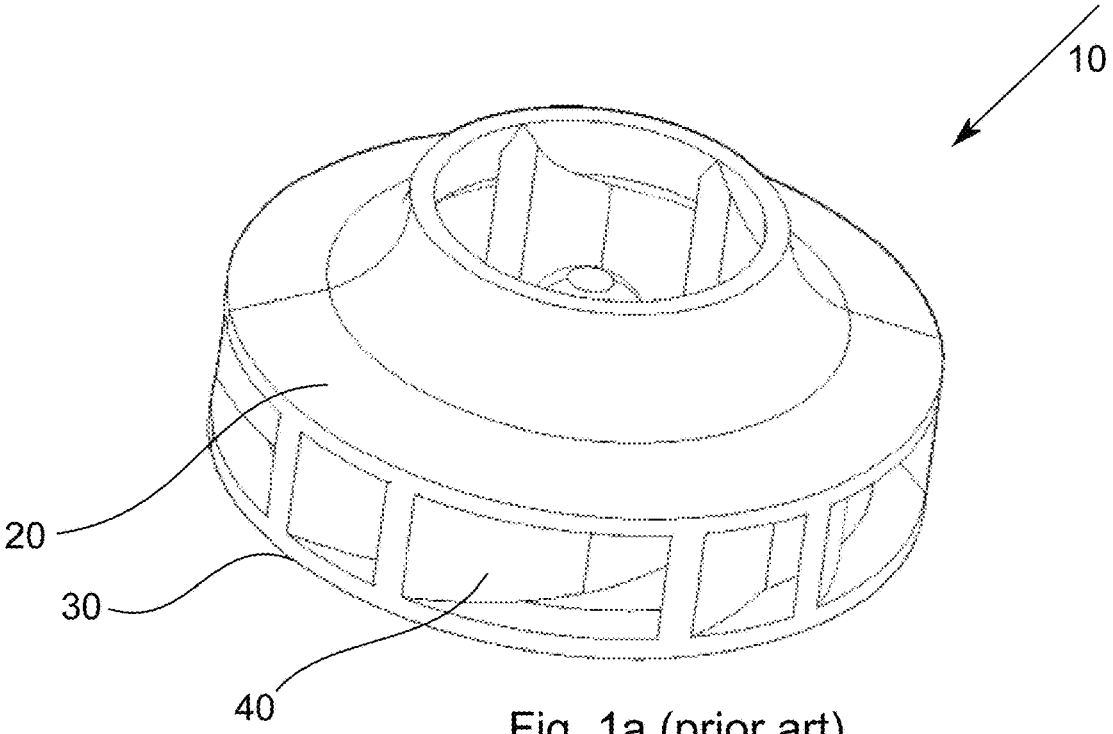
Fig. 1a (prior art)
FIG. 1*a* is a perspective view of an impeller according to the state of art.
Figure 1B:
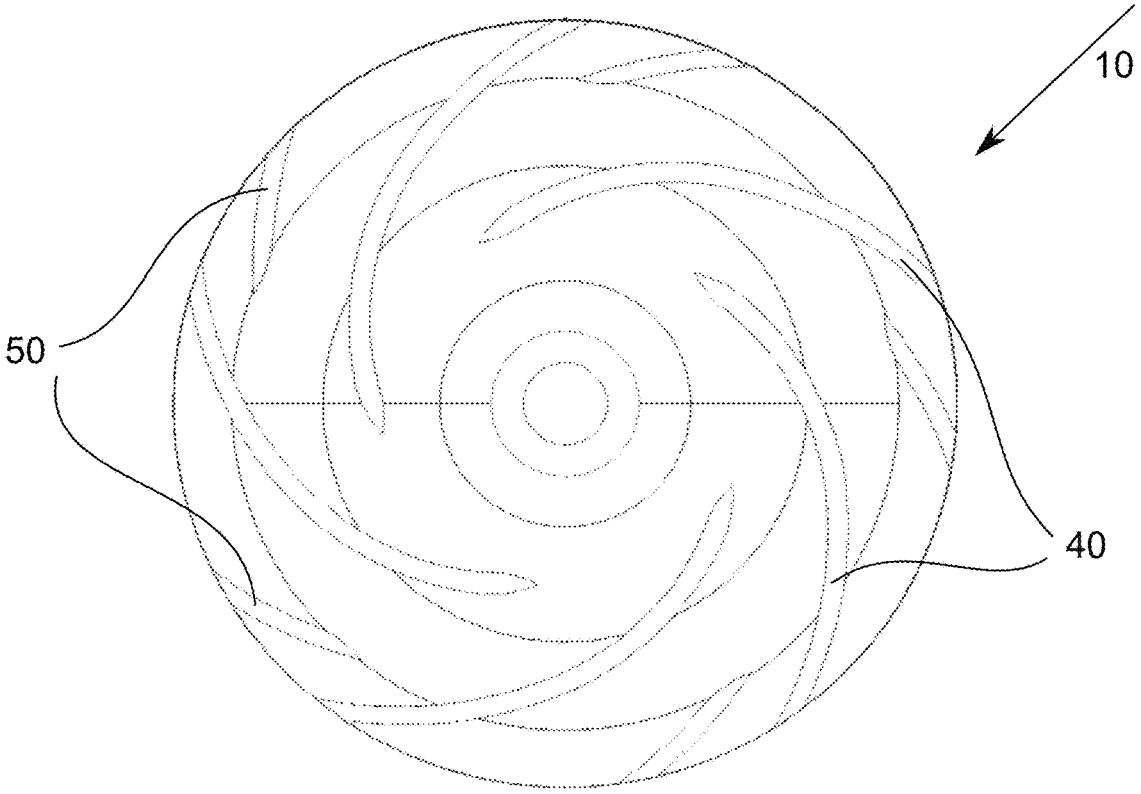
Fig. 1b (prior art)
FIG. 1*b* is a sectional top view cut along a plane perpendicular to the rotational axis of the impeller of FIG. 1*a*.

FIG. 1*a* depicts a perspective view of an impeller 10 according to the state of art. Impeller 10 includes a top plate 20 having a central opening and an opposing bottom plate 30, wherein vertical aligned blades 40 are arranged therebetween. A rotor shaft (not shown) is coupled to a central recess of bottom plate 30 to rotate impeller 10 about its rotational axis. Blades 40 are curved in a direction perpendicular to the rotational axis of impeller 10 to form a C-shape, seen from a top sectional view of FIG. 1*b*, wherein blades 40 extend from the center to an outer circumference of top plate 20 and bottom plate 30, respectively. According to this, fluid enters impeller 10 at the central opening, flows through an interior formed by top plate 20 and bottom plate 30, and out in the direction perpendicular to the rotational axis of impeller 10 at the outer circumference of top plate 20 and bottom plate 30. As can be best seen in FIG. 1*b*, showing a sectional top view cut along a plane perpendicular to the rotational axis of impeller 10 of FIG. 1*a*, blades 40 are curved to form a C-shape. Further, a respective sub-blade 50 is arranged between two subsequently blades 40.

Figure 2A:
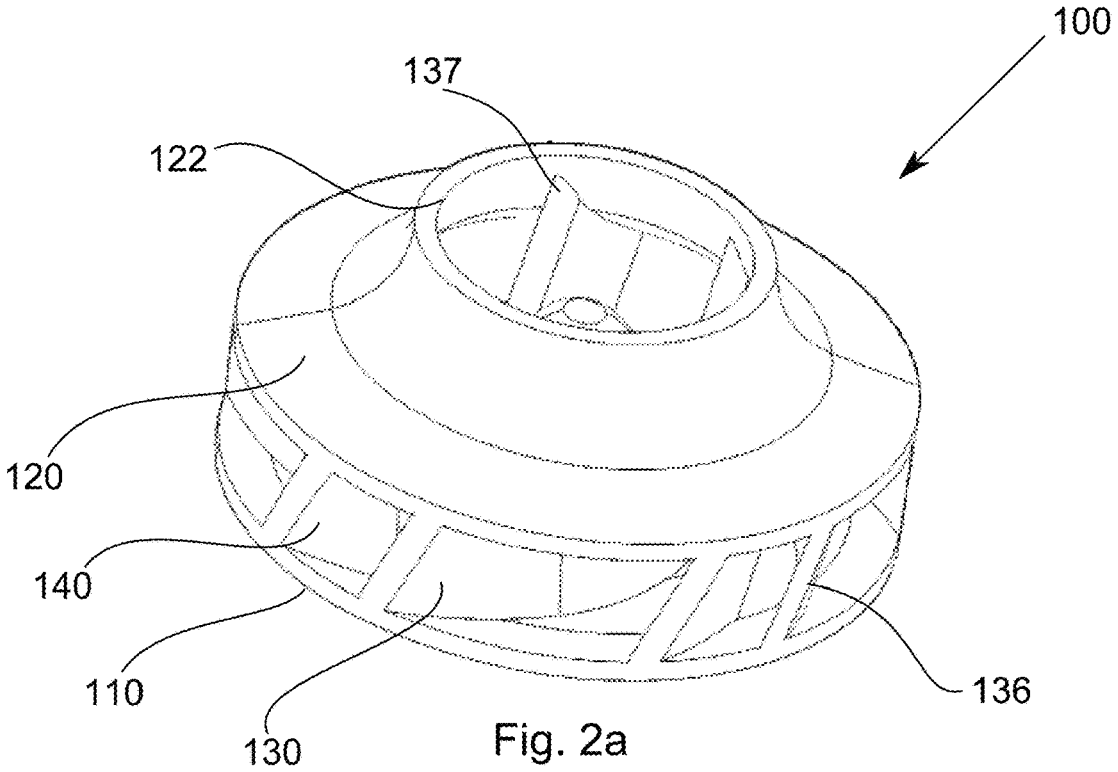
FIG. 2*a* is a perspective view of an impeller according to an embodiment of the present invention.

FIG. 2*a* shows a perspective view of an impeller 100 according to an embodiment of the present invention. Impeller 100 for a fluid pump comprises a lower pump plate 110 having at least one coupling section 112 configured to be coupled to a rotor shaft RS for driving impeller 100 about its rotational axis R. Impeller 100 further comprises an upper pump plate 120 opposing lower pump plate 110 and having a central opening 122 for providing an inlet for a fluid to be pumped. A plurality of blades 130 are arranged between lower pump plate 110 and upper pump plate 120. Lower pump plate 110 and upper pump plate 120 both have an outer circumference forming an outlet for the pumped fluid. According to this, the fluid flows in a fluid flow direction F from the fluid inlet through a pump interior formed by lower 110 and upper pump plate 120, and out at the fluid outlet.

Each of blades 130 has a suction surface 131, a pressure surface 132 opposing suction surface 131, side edges 133, 134, 135, 136 and a longitudinal axis extending at least substantially in fluid flow direction F: a first longitudinal side edge 133 of each blade 130 being attached to upper pump plate 120, a second longitudinal side edge 134 of each blade 130 opposing first longitudinal side edge 133, and being attached to lower pump plate 110, an inflow side edge 135 of each blade 130 being arranged at least substantially in the opposite direction of the fluid flow F, and an outflow side edge 136 opposing inflow side edge 135, and being arranged at least substantially in the direction of fluid flow F.

Further, as can be best seen in FIG. 2*a*, an angle is formed between outflow side edge 136 and lower pump plate 110, which is an acute angle. An acute angle is an angle that measures between 90° and 0°, meaning it is smaller than a right angle (an "L" shape) but has at least some space between the two lines that form it. In this particular case, the angle between outflow side edge 136 and lower pump plate 110 is approximately 60°.

Moreover, lower pump plate 110 comprises a cross-section which corresponds to a hat-like trapezoid with rounded edges, and wherein the hat-like trapezoid with rounded edges corresponds to a bell-like trapezoid with rounded edges. Upper pump plate 120 comprises a cross-section which decreases steadily, in particular exponentially, from the inside to the outside.

Figure 2B:
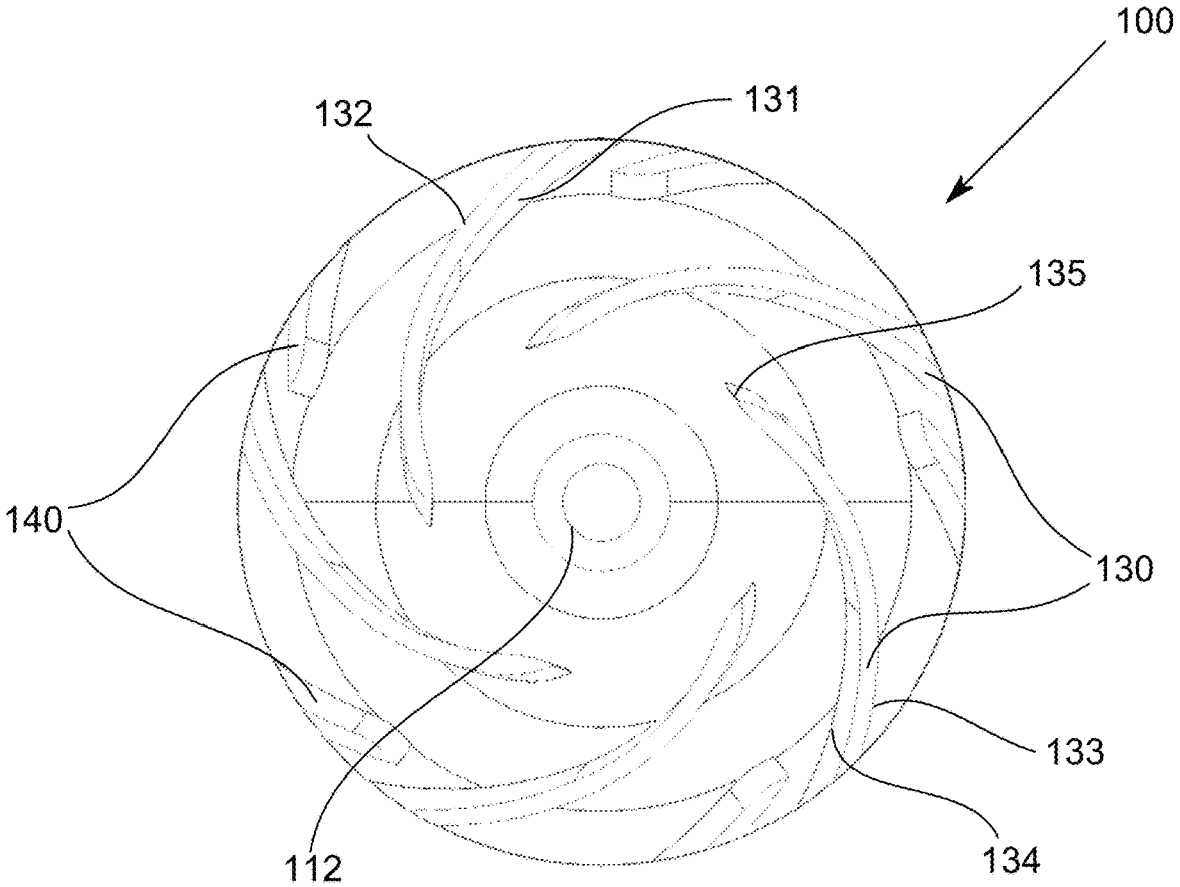
FIG. 2*b* is a sectional top view cut along a plane perpendicular to the rotational axis of the impeller of FIG. 2*a*.

Referring to FIG. 2*b*, each blade 130 of impeller 100 is circularly arranged in regular intervals from each other between lower pump plate 110 and upper pump plate 120. According to the embodiment shown in FIGS. 2*a* and 2*b*, impeller 100 includes five blades 130. Moreover, impeller 100 further comprises a plurality of sub-blades 140, i.e. five in this particular embodiment, arranged between lower pump plate 110 and upper pump plate 120, and extending from the outer circumference of lower pump plate 110 and upper pump plate 120 to the interior formed by lower pump plate 110 and upper pump plate 120. Thus, impeller 100 comprises five blades 130 and five corresponding sub-blades 140. The radial extension of sub-blades 140 is less than the radial extension of blades 130. Sub-blades 140 are used to increase the pressure inside impeller 100 and thereby enhancing efficiency of a pump including impeller 100. Each sub-blade 140 opposing two blades 130 and is associated to a respective blade 130, wherein a distance between a sub-blade 140 to an associated blade 130 is different to another opposing blade 130. Further, each blade 130 is torqued or rather twisted in the direction perpendicular to rotational axis R of impeller 100. Additionally, each blade 130 and sub-blade 140 of impeller 100 is tapered towards respective inflow side edge 135.

An upper section 137 of each blade 130, formed between first longitudinal side edge 133 and inflow side edge 135, extends at least partially into central opening 122 of upper pump plate 120, thereby upper section 137 of each blade 130 has a substantially frustum shape with a rounded outer circumference.

Besides, the height of each blade 130 measured from first longitudinal side edge 133 to second longitudinal side edge 134 decreases steadily in the direction perpendicular to rotational axis R of impeller 100 form the inside to the outside. Furthermore, each blade 130 terminates at the outer circumference of lower pump plate 110 and upper pump plate 120.

Figure 3A:
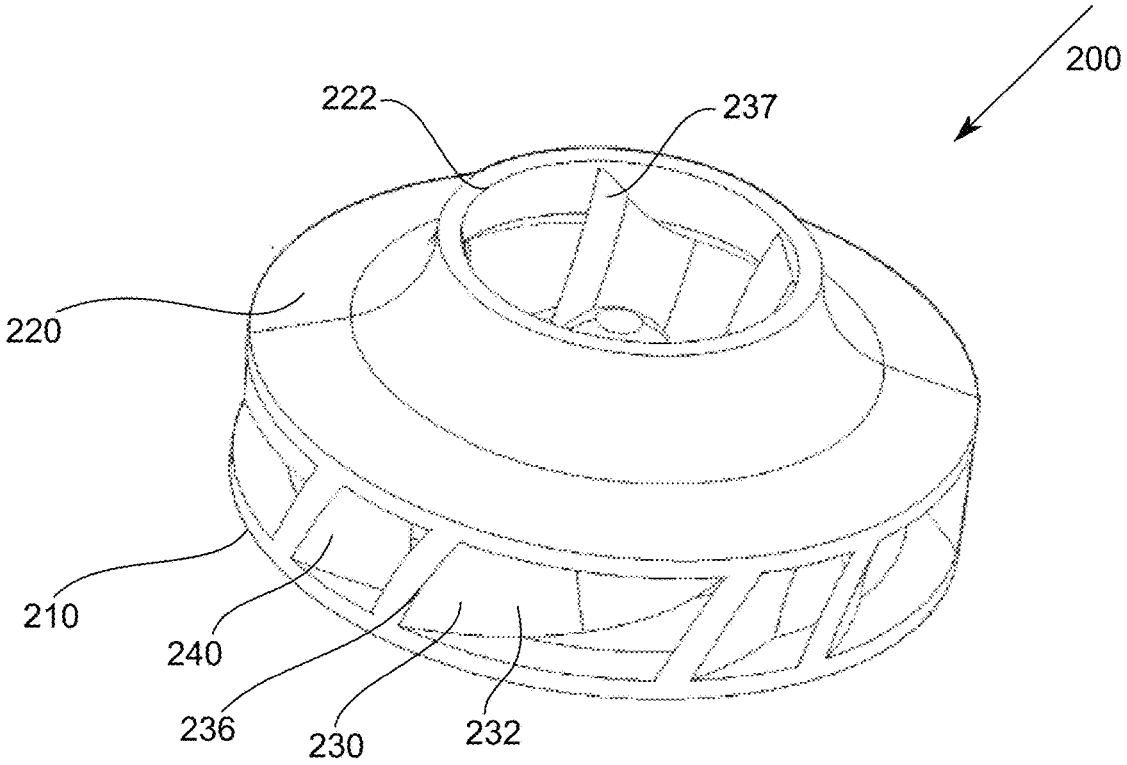
FIG. 3*a* is a perspective view of an impeller according to a further embodiment of the present invention.
Figure 3B:
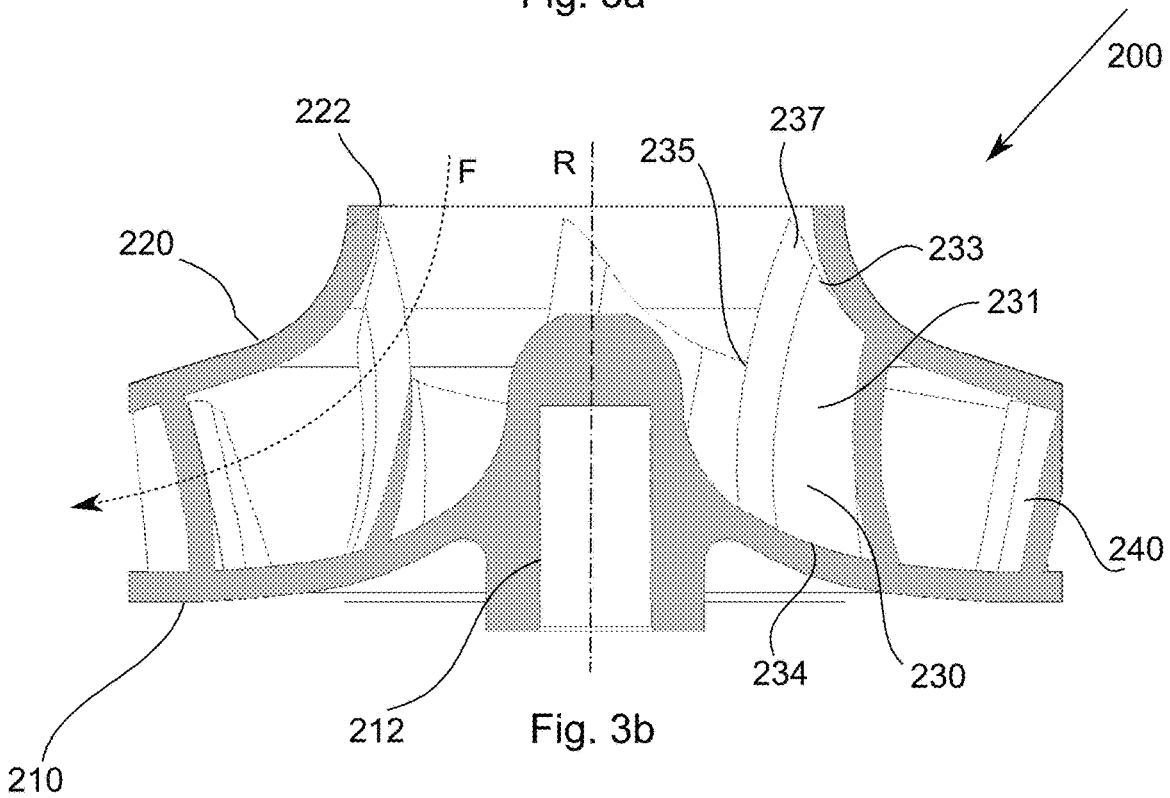
FIG. 3*b* is a sectional side view cut along a plane parallel to the rotational axis of the impeller of FIG. 3*a*.

FIG. 3*a* depicts a perspective view of an impeller 200 according to a further embodiment of the present invention. Moreover, FIG. 3*b* is a sectional side view cut along a plane parallel to rotational axis R of impeller 200 of FIG. 3*a*.

Impeller 200 for a fluid pump P comprises a lower pump plate 210 having at least one coupling section 212 configured to be coupled to a rotor shaft RS (not shown) for driving impeller 200 about its rotational axis R. Impeller 200 further comprises an upper pump plate 220 opposing lower pump plate 210 and having a central opening 222 for providing an inlet for a fluid to be pumped, and a plurality of blades 230 arranged between lower pump plate 210 and upper pump plate 220. Lower pump plate 210 and upper pump plate 220 both have an outer circumference forming an outlet for the pumped fluid. According to this, the fluid flows in a fluid flow direction F from the fluid inlet through a pump interior formed by lower pump plate 210 and upper pump plate 220, and out at the fluid outlet.

Figure 3C:
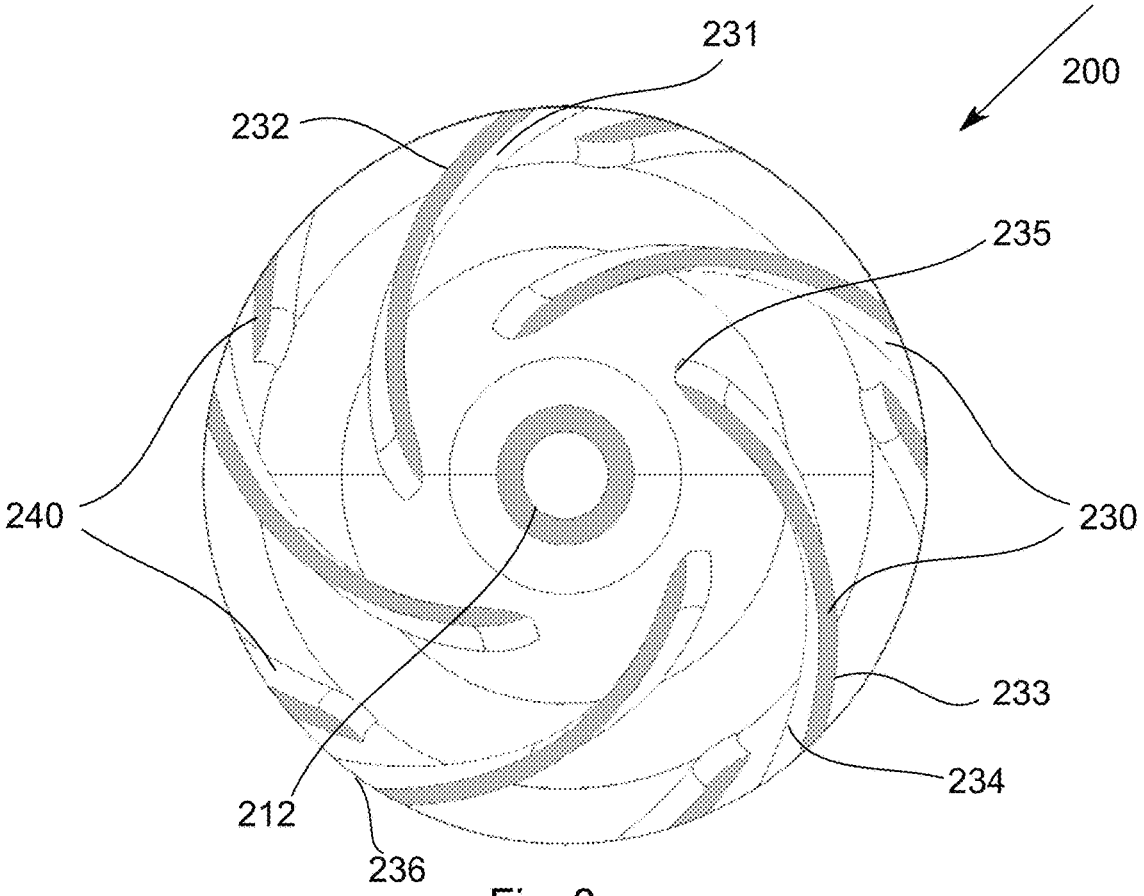
FIG. 3*c* is a sectional top view cut along a plane perpendicular to the rotational axis of the impeller of FIG. 3*a*.
Figure 3D:
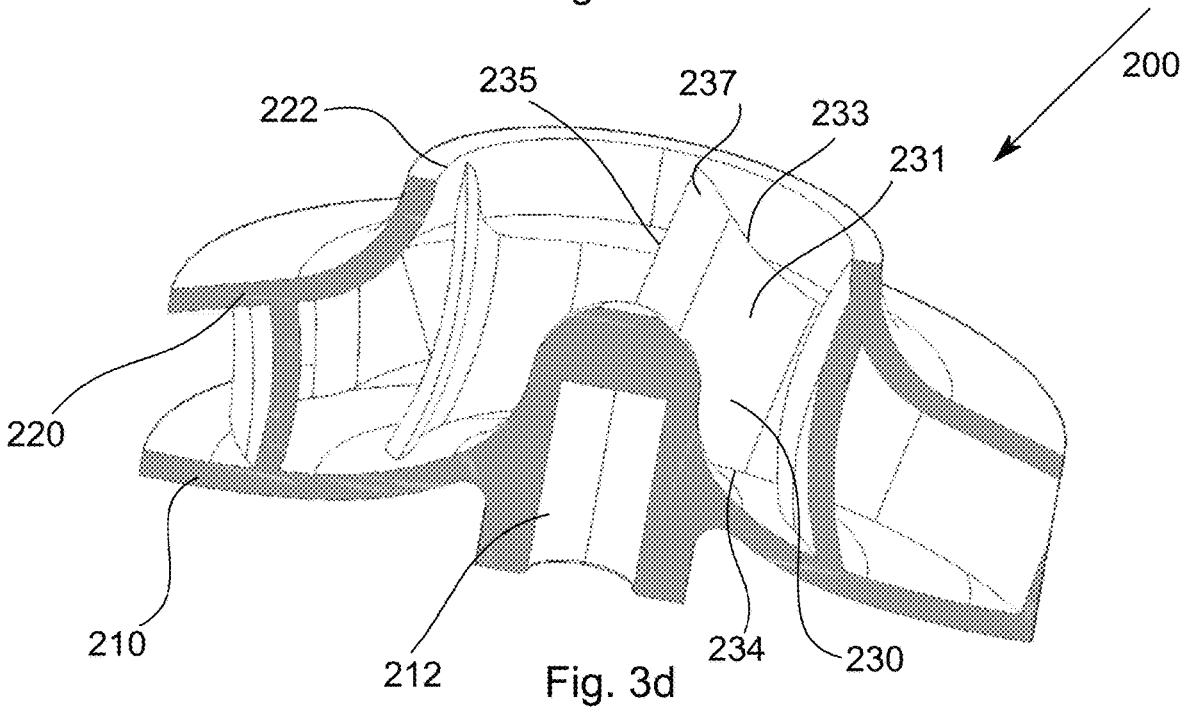
FIG. 3*d* is a perspective sectional view cut along a plane parallel to the rotational axis of the impeller of FIG. 3*a*.
Figure 4A:
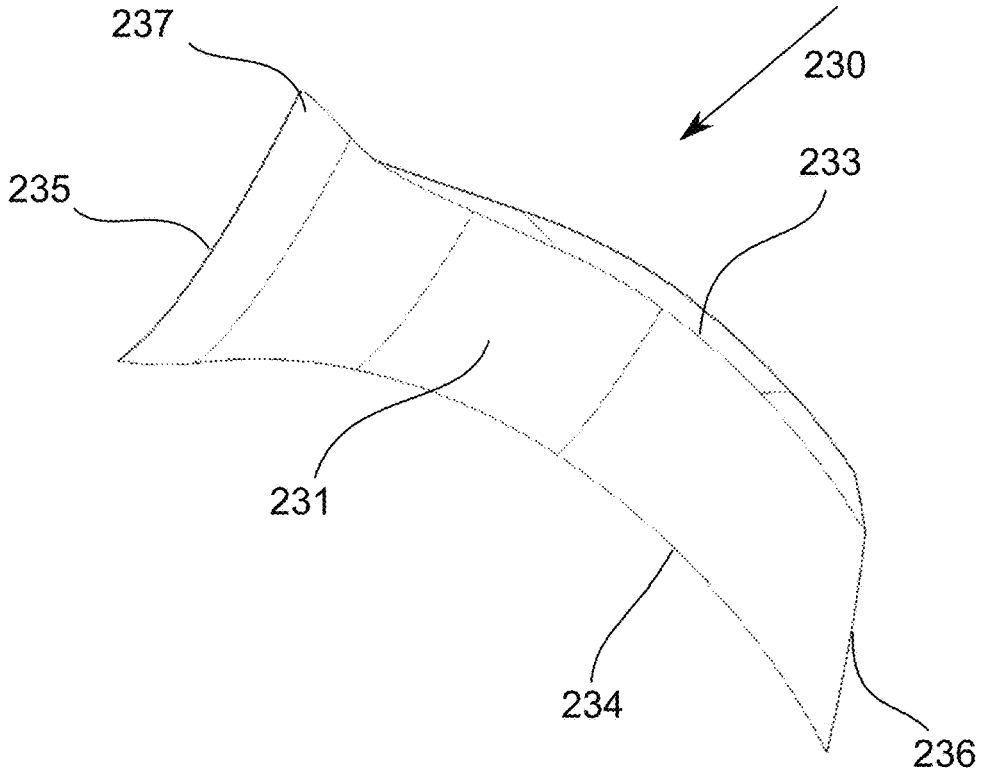
FIG. 4*a* is a perspective view of a blade according to the embodiment shown in FIGS. 3*a* to 3*d*.
Figure 4B:
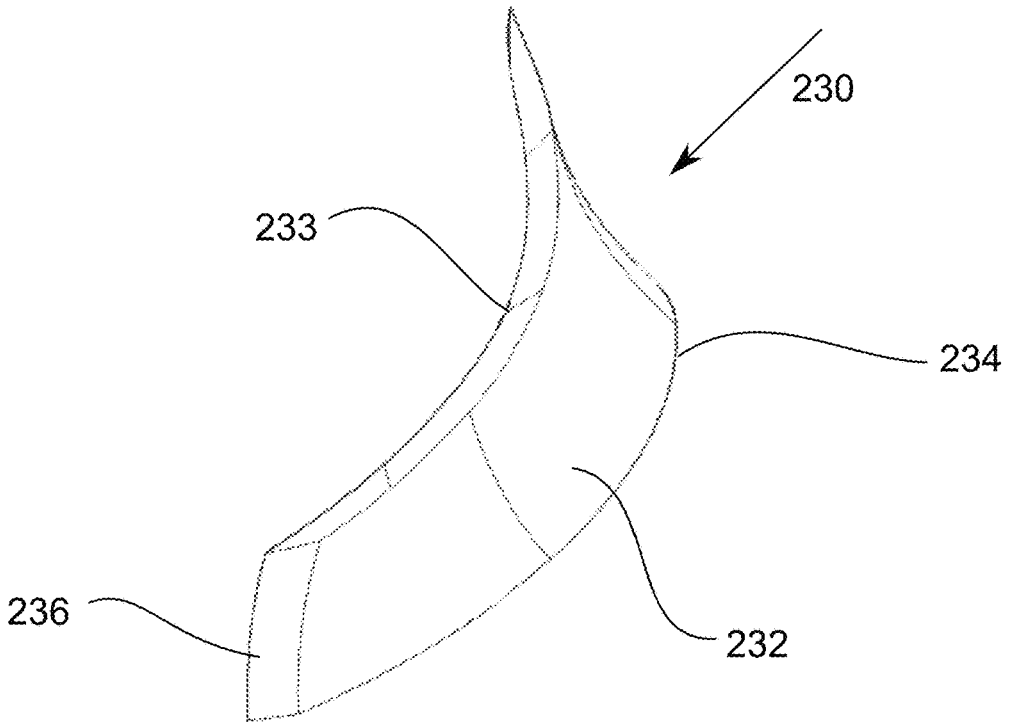
FIG. 4*b* is another perspective view of the blade shown in FIG. 4*a*.

FIGS. 4*a* and 4*b* show different perspective views of a blade 230 used in impeller 200 depicted in FIGS. 3*a* to 3*d*. Each of blades 230 has a suction surface 231, a pressure surface 232 opposing suction surface 231, side edges 233, 234, 235, 236 and a longitudinal axis extending at least substantially in fluid flow direction F: a first longitudinal side edge 233 of each blade 230 being attached to upper pump plate 220, a second longitudinal side edge 234 of each blade 230 opposing first longitudinal side edge 233, and being attached to lower pump plate 210, an inflow side edge 235 of each blade 230 being arranged at least substantially in the opposite direction of the fluid flow F, and an outflow side edge 236 opposing inflow side edge 235, and being arranged at least substantially in the direction of the fluid flow F.

Further, as can be best seen in FIG. 3*a*, an angle is formed between outflow side edge 236 and lower pump plate 210, which is an acute angle. In this particular case, the angle between outflow side edge 236 and lower pump plate 210 is approximately 60°.

Additionally, suction surface 231 of each blade 230 has at least partially a convex curvature extending at least substantially in the direction of rotational axis R of impeller 200. As a result, efficiency of impeller 200 may be enhanced even further. Pressure surface 232 of each blade 230 has at least partially a concave curvature extending at least substantially in the direction of rotational axis R of impeller 200. The convex and/or concave curvatures extend substantially along the entire surface of each blade 230 in direction of the longitudinal axis extending at least substantially in fluid flow direction F.

Additionally, inflow side edge 235 and outflow side edge 236 of each blade 230 is curved substantially in the direction of rotational axis R of impeller 200.

Lower pump plate 210 and upper pump plate 220 of impeller 200 depicted in FIGS. 3*a* to 3*d* correspond to lower pump plate 110 and upper pump plate 120 of impeller 100 shown in the embodiment of FIGS. 2*a* and 2*b*.

Thus, as can be best seen in FIG. 3*b*, lower pump plate 210 comprises a cross-section which corresponds to a hat-like trapezoid with rounded edges, and wherein the hat-like trapezoid with rounded edges corresponds to a bell-like trapezoid with rounded edges. Upper pump plate 220 comprises a cross-section which decreases steadily, in particular exponentially, from the inside to the outside.

FIG. 3*c* is a sectional top view cut along a plane perpendicular to rotational axis R of impeller 200 of FIG. 3*a*. Each blade 230 is torqued in the direction perpendicular to rotational axis R of impeller 200. Additionally, each blade 230 and sub-blade 240 of impeller 200 is tapered towards the respective inflow side edge 235.

As can be best seen in FIG. 3*d*, which is a perspective sectional view cut along a plane parallel to rotational axis R of impeller 200 of FIG. 3*a*, inflow side edge 235 of each blade 230 is curved substantially in the direction of rotational axis R of impeller 200.

Figure 5A:
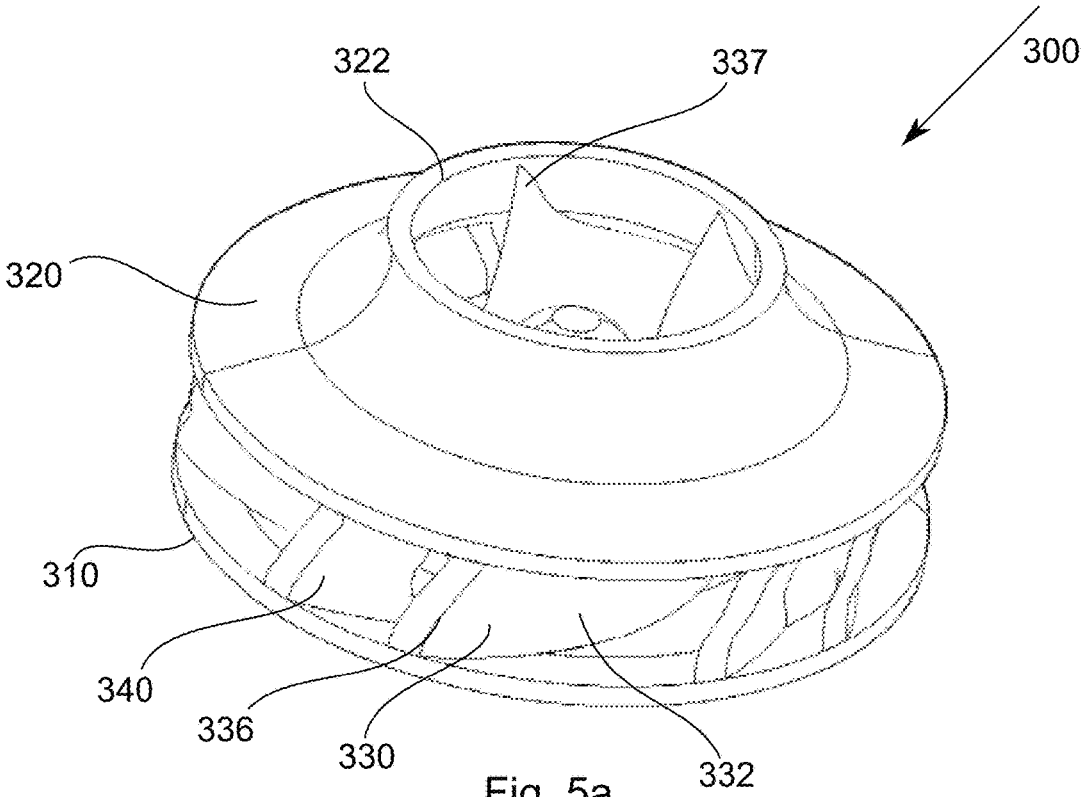
FIG. 5*a* is a perspective view of an impeller according to another embodiment of the present invention.
Figure 5B:
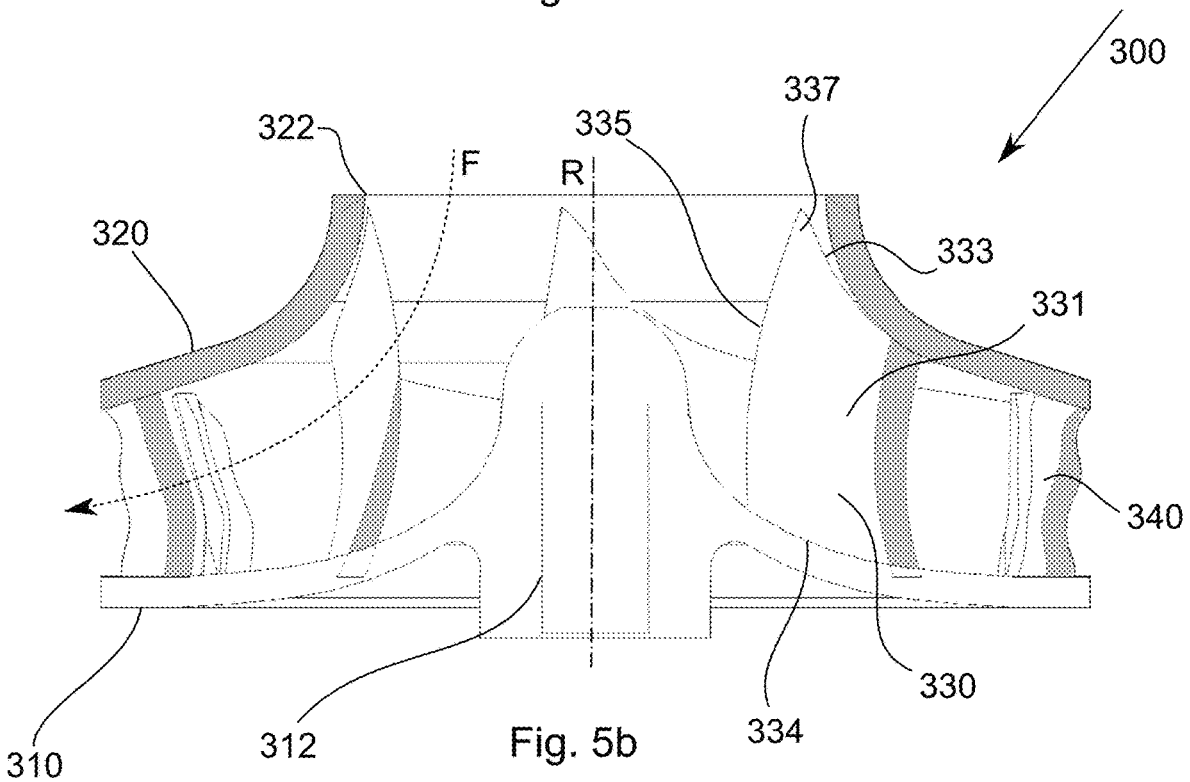
FIG. 5*b* is a sectional side view cut along a plane parallel to the rotational axis of the impeller of FIG. 5*a*.

FIG. 5*a* shows a perspective view of an impeller 300 according to another embodiment of the present invention, wherein FIG. 5*b* is a corresponding sectional side view cut along a plane parallel to rotational axis R of impeller 300 of FIG. 5*a*.

The embodiment of impeller 300 shown in FIGS. 5*a* and 5*b* mostly corresponds to that depicted in FIGS. 3*a* to 3*d* with the exception that each blade 330 and each sub-blade 340 comprises a cross-section which has a wave-form or rather a fin-form, wherein the wave-form includes an upward portion and a downward portion.

Figure 6A:
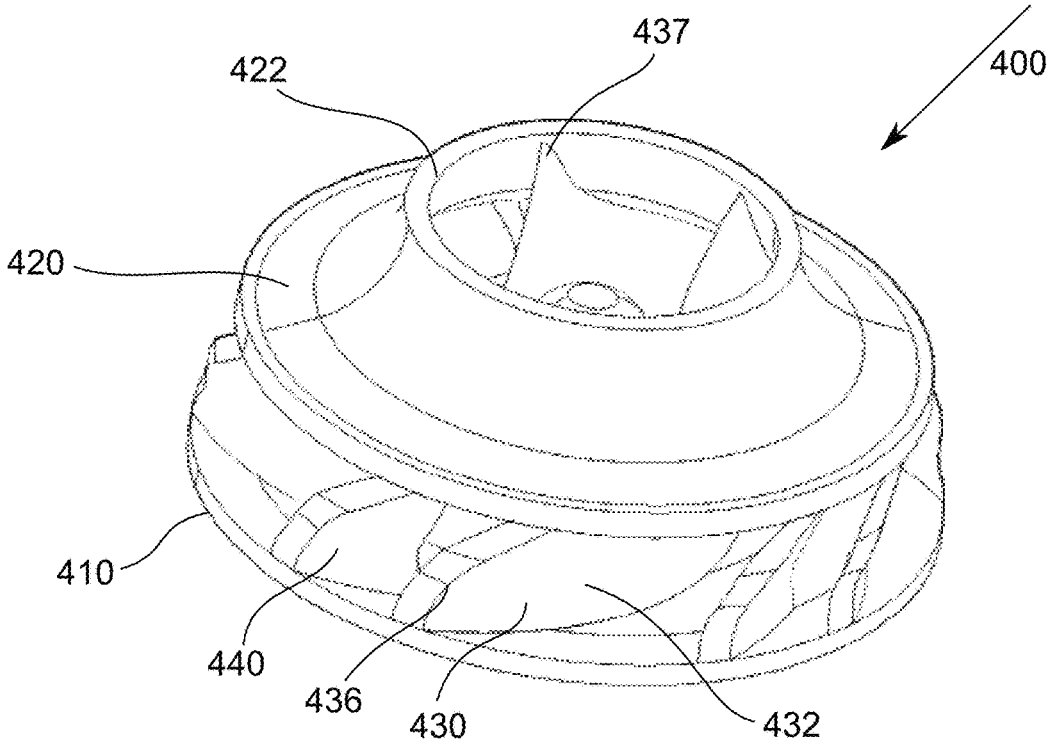
FIG. 6*a* is a perspective view of an impeller according to a further embodiment of the present invention.

FIG. 6*a* depicts a perspective view of an impeller 400 according to a further embodiment of the present invention.

Figure 6B:
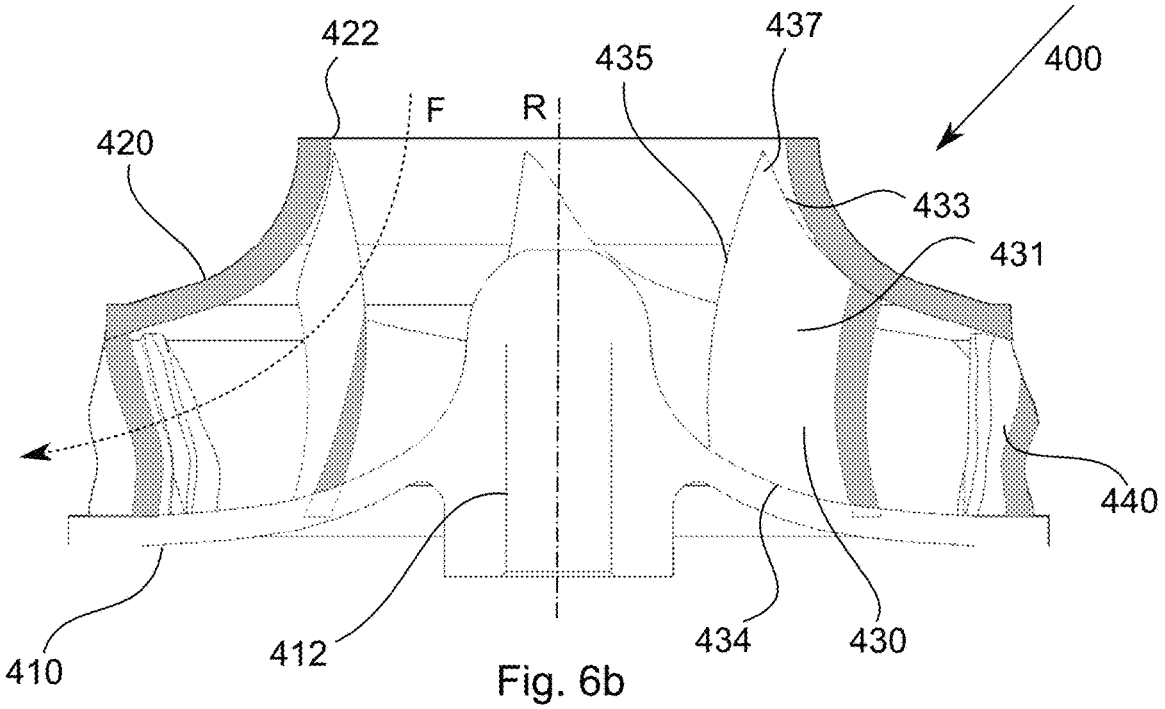
FIG. 6*b* is a sectional side view cut along a plane parallel to the rotational axis of the impeller of FIG. 6*a*.

FIG. 6*b* is a sectional side view cut along a plane parallel to rotational axis R of impeller 400 of FIG. 6*a*.

The embodiment of impeller 400 shown in FIGS. 6*a* and 6*b* mostly corresponds to that depicted in FIGS. 5*a* to 5*b* with the exception that the outer circumference of lower pump plate 410 is larger than the outer circumference of upper pump plate 420. This increases the outlet surface of the fluid outlet.

Figure 7A:
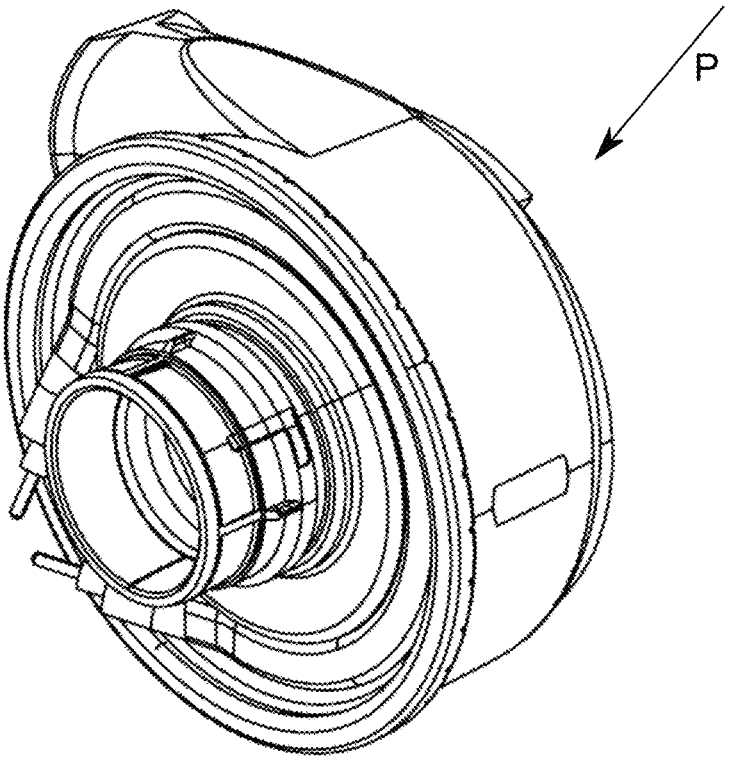
FIG. 7*a* is a perspective view of a pump according to an embodiment of the present invention.
Figure 7B:
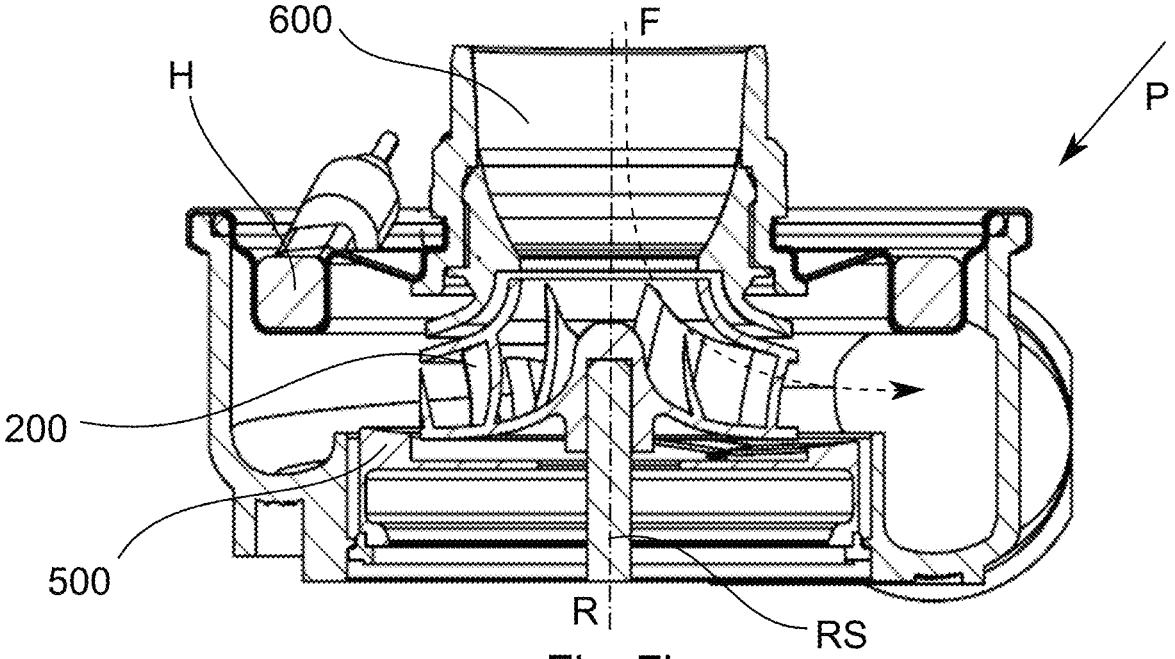
FIG. 7*b* is a sectional view cut along a plane parallel to the rotational axis of the impeller of the pump of FIG. 7*a*.

FIG. 7*a* depicts a perspective view of a pump P according to an embodiment of the present invention and FIG. 7*b* is a perspective sectional view cut along a plane parallel to rotational axis R of impeller of pump P of FIG. 7*a*.

As best seen in FIG. 7*b*, pump P comprises a pumping chamber including a central axial fluid inlet and a tangential fluid outlet, and an impeller 10; 100; 200; 300; 400 for conveying fluid. Impeller 10; 100; 200; 300; 400 rotating within the pumping chamber. Pump P further comprises a motor (not shown) including a rotor shaft RS, wherein the rotor shaft RS is attached to the at least one coupling section 112; 212; 312; 412 of impeller 10; 100; 200; 300; 400. A heating unit H is arranged near the inner circumference of pumping chamber for heating the fluid.

As can be inferred from FIG. 7*b*, pump P further includes a pressure wall 500 arranged underneath impeller 10; 100; 200; 300; 400. Pressure wall 500 is described in more detail with respect to FIGS. 8*a*, 8*b*, 9*a* and 9*b* below. Pump P further comprises a pressure bushing 600 arranged on top of central opening 122; 222; 322; 422 of upper pump plate 20; 120; 220; 320; 420 of impeller 100; 200; 300; 400, and which is used for guiding fluid towards inlet of impeller 10; 100; 200; 300; 400. Pressure bushing 600 is described in detail with respect to FIGS. 10*a* and 10*b* below. Pressure wall 500 and pressure bushing 600 can be used with any conventional pump.

Figure 8A:
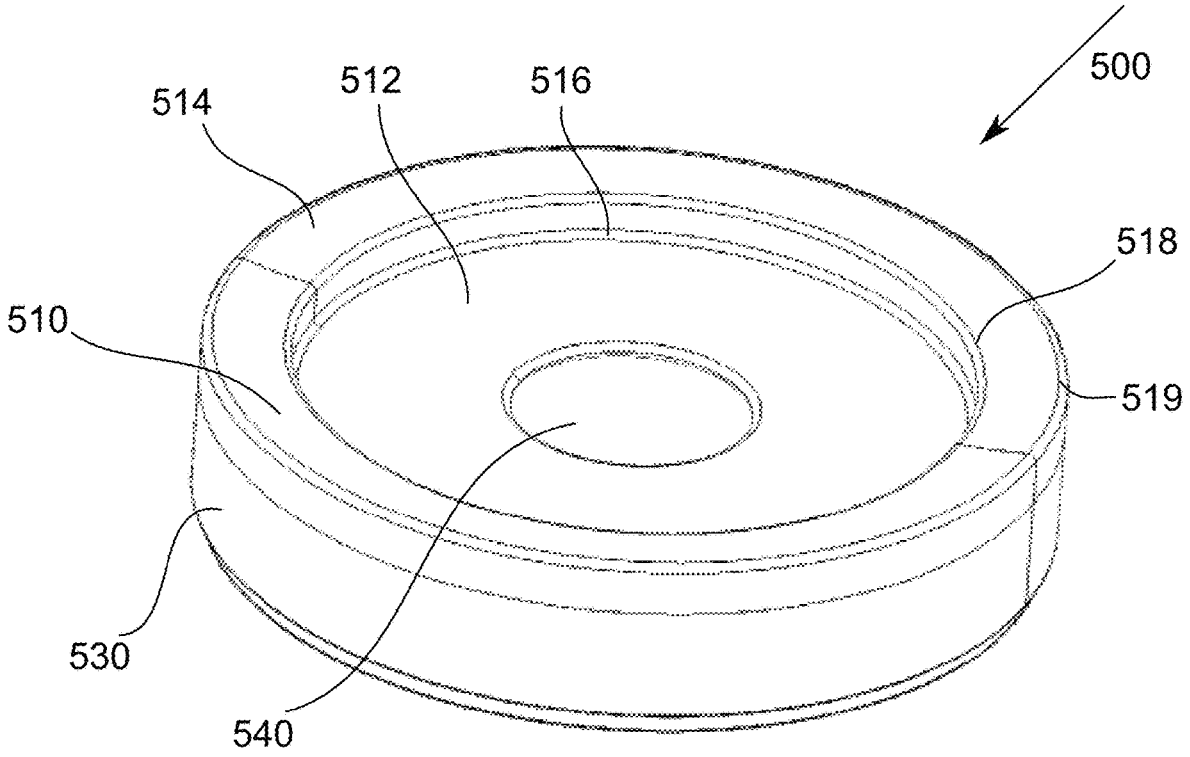
FIG. 8*a* is a perspective view of a pressure wall according to an embodiment of the present invention.
Figure 8B:
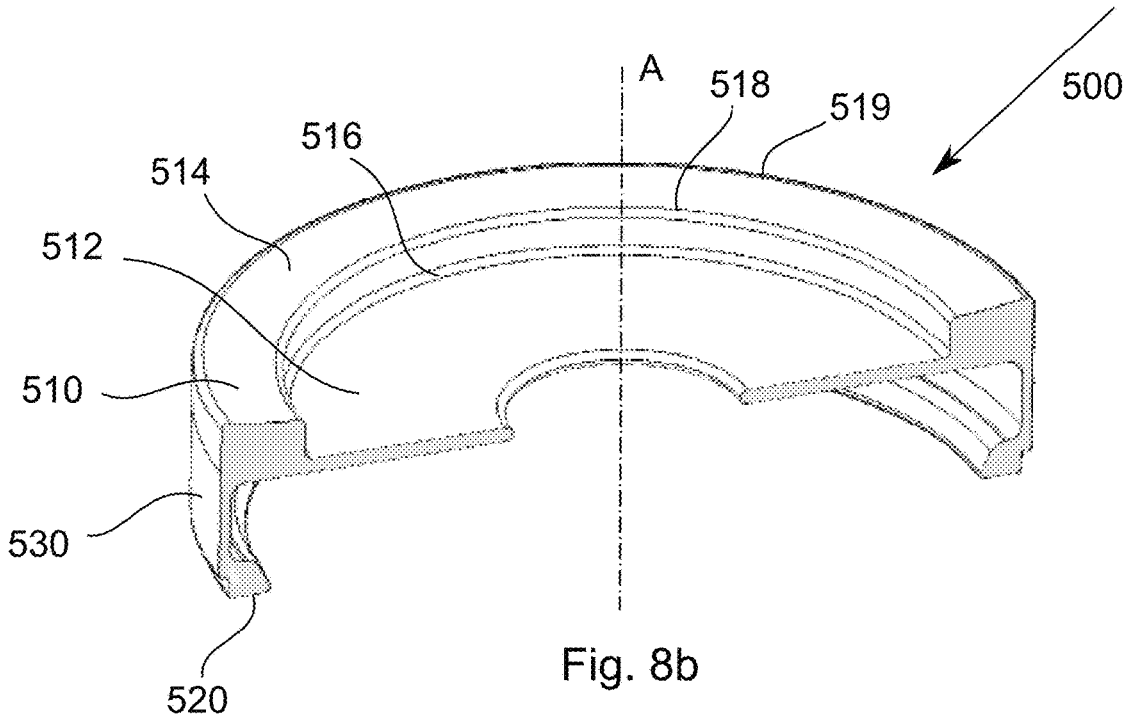
FIG. 8*b* is a perspective sectional side view cut along a plane parallel to the central axis of the pressure wall of FIG. 8*a*.

FIG. 8*a* depicts a perspective view of a pressure wall 500 according to an embodiment of the present invention. FIG. 8*b* is a perspective sectional side view cut along a plane parallel to the central axis A of pressure wall 500 of FIG. 8*a*. As can be best seen in FIG. 7*b*, pressure wall 500 is arranged underneath impeller 10; 100; 200; 300; 400 of pump P. Pressure wall 500 is used to guide fluid conveyed out of impeller 10; 100; 200; 300; 400 to an outlet port of pump P.

According to this, pressure wall 500 has substantially the shape of a disc. Disc-shaped pressure wall 500 has a central axis A. Pressure wall 500 comprises a top surface 510, and a bottom surface 520 opposing top surface 510, wherein top surface 510 includes an inner surface section 512 and an outer surface section 514. Inner surface section 512 extends radially from central axis A and is recessed to form a central recess 516. Outer surface section 514 includes an inner circumferential edge portion 518 and an outer circumferential edge portion 519, wherein inner circumferential edge portion 518 is located closer to central axis A than outer circumferential edge portion 519. Outer circumferential edge portion 519 is located higher than the inner circumferential edge portion 518 with respect to a plane perpendicular to central axis A and passing through inner circumferential edge portion 518. Further, pressure wall 500 comprises a cylindrical side surface 530.

Pressure wall 500 further comprises a central through hole 540 extending at least substantially along central axis A for bearing an impeller 10; 100; 200; 300; 400 of pump P. The height of outer surface section 514 measured from inner circumferential edge portion 518 to outer circumferential edge portion 519 increases in the direction perpendicular to central axis A of pressure wall 500. Outer surface section 514 is inclined towards central axis A of pressure wall 500. Moreover, outer surface section 514 has a concave shape extending substantially around the entire circumference of outer surface section 514.

Figure 9A:
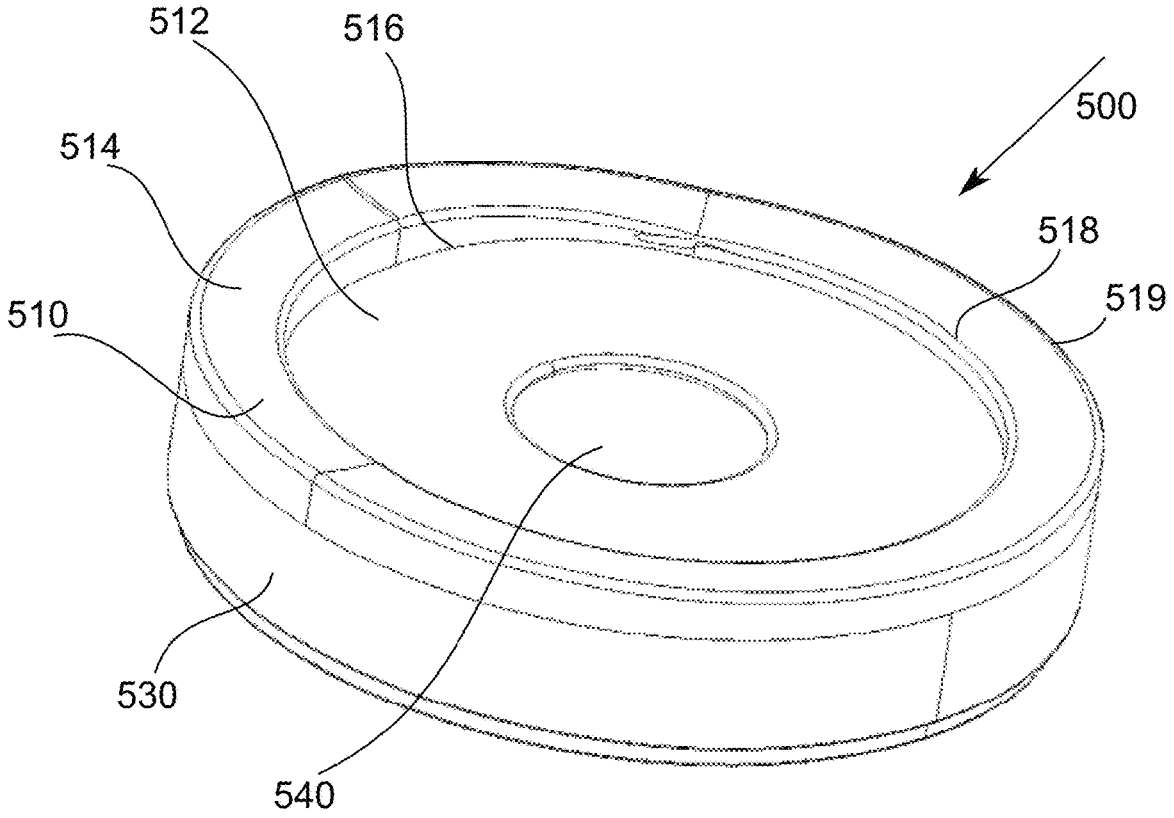
FIG. 9*a* is a perspective view of a pressure wall according to a further embodiment of the present invention.
Figure 9B:
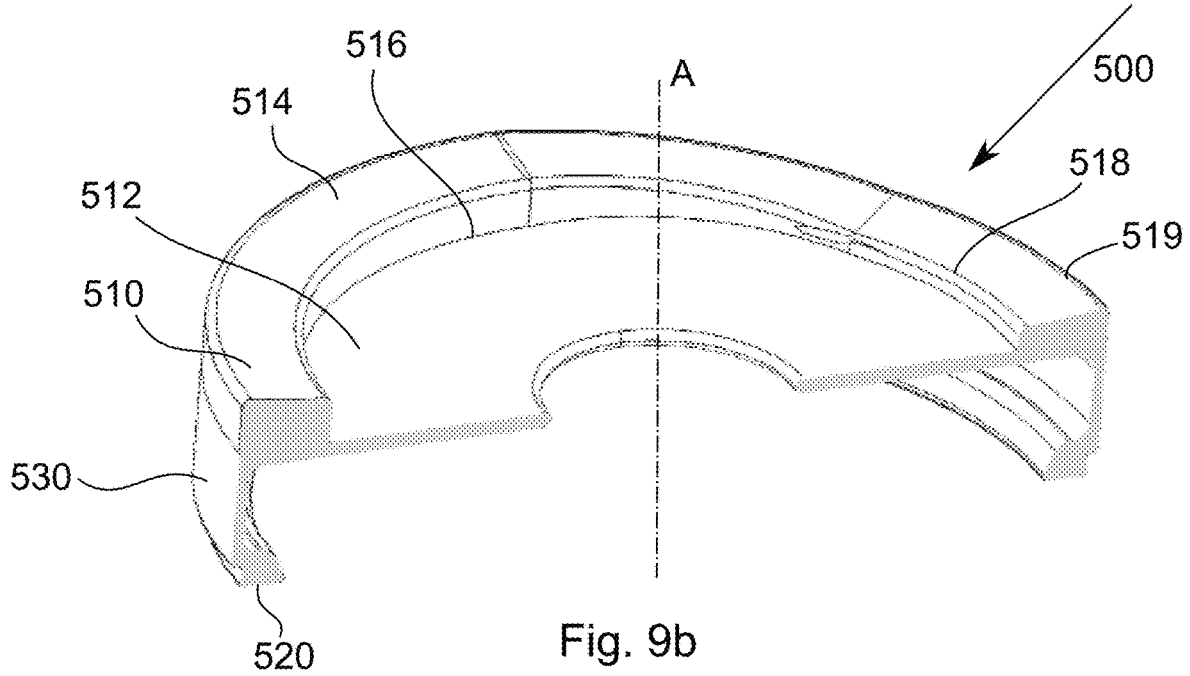
FIG. 9*b* is a sectional side view cut along a plane parallel to the central axis of the pressure wall of FIG. 9*a*.

FIG. 9*a* is a perspective view of a pressure wall 500 according to a further embodiment of the present invention. FIG. 9*b* is a sectional side view cut along a plane parallel to the central axis A of pressure wall 500 of FIG. 9*a*.

The embodiment of pressure wall 500 shown in FIGS. 9*a* and 9*b* mostly corresponds to that depicted in FIGS. 8*a* and 8*b* with the exception that outer surface section 514 of top surface 510 of pressure wall 500 has in addition to the concave shape a helical shape which extends in direction towards central axis A of pressure wall 500. Helical shape extends almost entirely around the entire circumference of outer surface section 514 of top surface 510 of pressure wall 500.

Figure 10A:
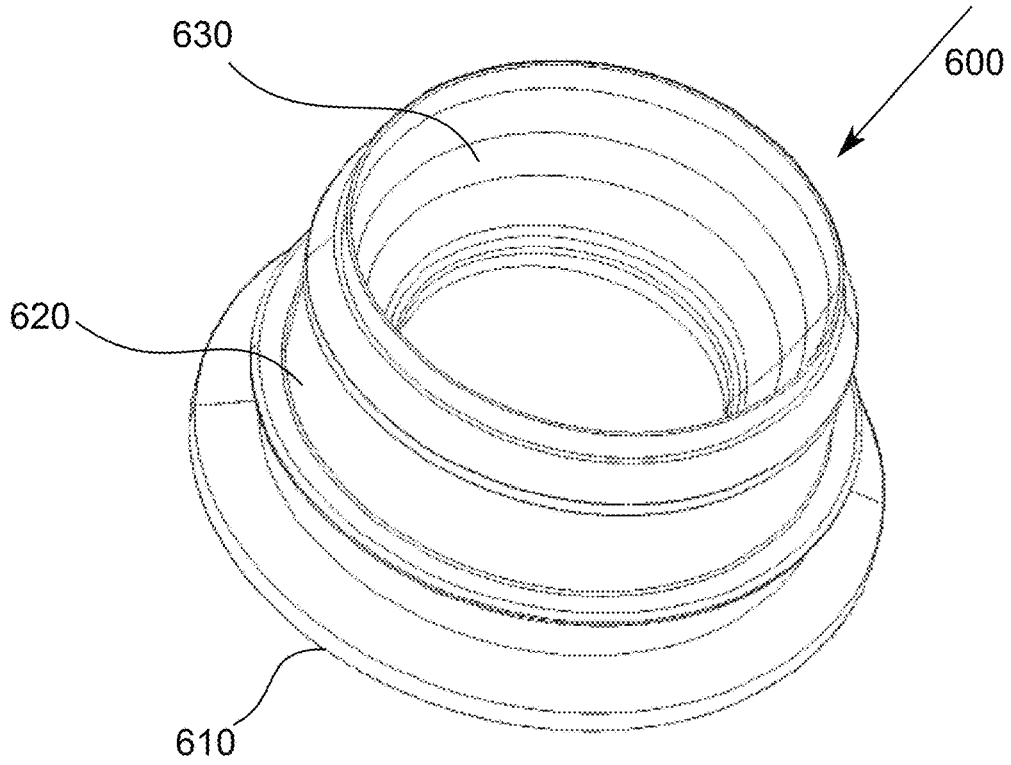
FIG. 10*a* is a perspective view of a pressure bushing according to an embodiment of the present invention.
Figure 10B:
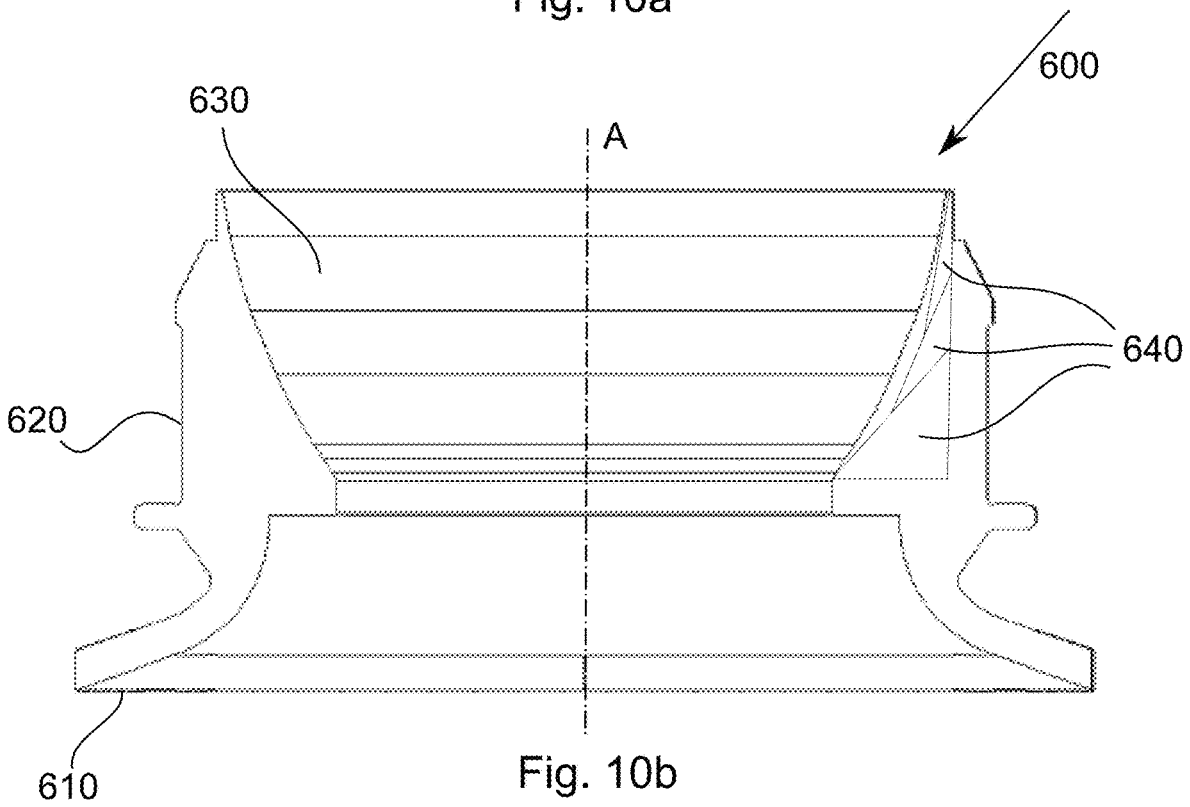
FIG. 10*b* is a sectional side view cut along a plane parallel to the central axis of the pressure bushing of FIG. 10*a*.

FIG. 10*a* shows a perspective view of a pressure bushing 600 according to an embodiment of the present invention. FIG. 10*b* depicts a sectional side view cut along a plane parallel to the central axis A of pressure bushing 600 of FIG. 10*a*.

As can be best seen in FIG. 10*b*, pressure bushing 600 comprises a bottom portion 610, an outer side portion 620 and an inner side portion 630. Bottom portion 610 is configured to match the contour of upper pump plate 20; 120; 220; 320; 420 of impeller 10; 100; 200; 300; 400 and can be attached thereto. This is particularly shown in pump P of FIGS. 7*a* and 7*b*.

Inner side portion 630 of pressure bushing 600 has an inner circumference, which tapers towards bottom portion 610 of pressure bushing 600, i.e. towards upper pump plate 20; 120; 220; 320; 420 of impeller 10; 100; 200; 300; 400 of pump P in an assembled configuration. In the embodiment shown in FIGS. 10*a* and 10*b*, inner circumference of inner side portion 630 of pressure bushing 600 tapers towards bottom portion 610 by the method of tensile triangles, with the resulting edges rounded. As shown in sectional view of FIG. 10*b*, the cross-section of inner side portion 630 of pressure bushing 600 is defined by three tensile triangles 640.

Figure 11:
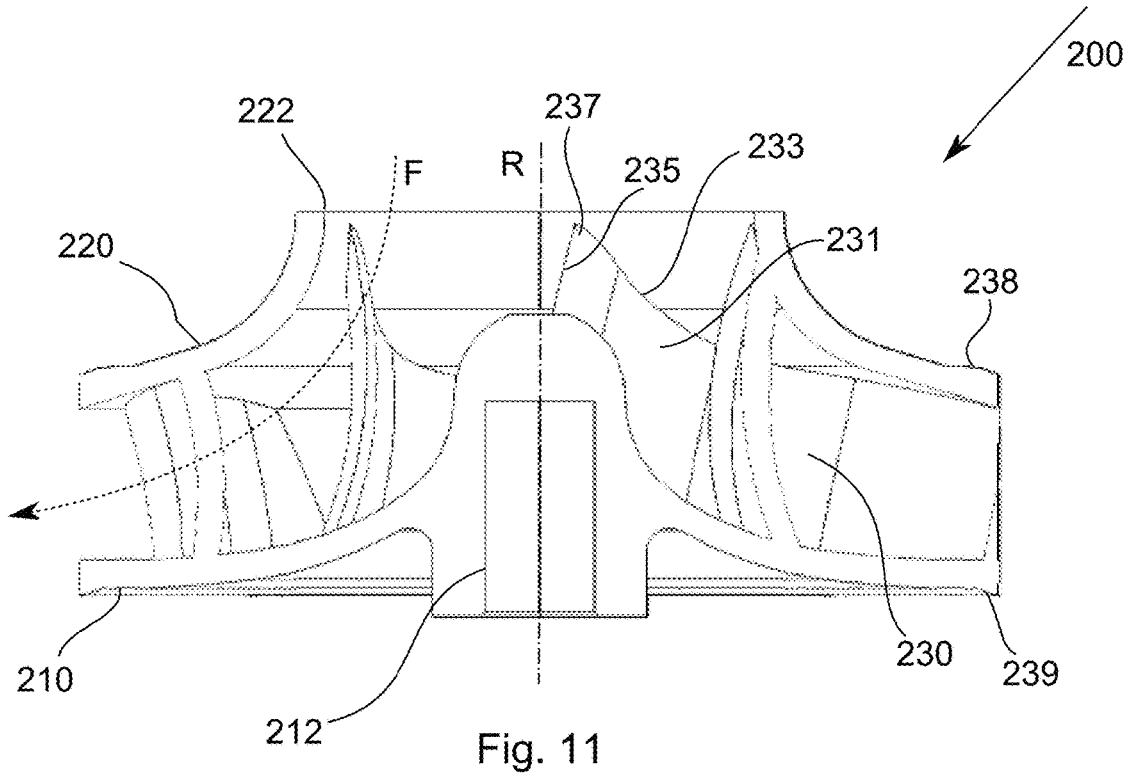
FIG. 11 is a sectional side view of an impeller cut along a plane parallel to the rotational axis of the impeller according to a further embodiment of the present invention.

FIG. 11 depicts a sectional side view of an impeller 200 cut along a plane parallel to rotational axis R of impeller 200 according to a further embodiment of the present invention.

The embodiment of impeller 200 shown in FIG. 11 mostly corresponds to that depicted in FIGS. 3*a* to 3*d* with the exception that a circumferential upper ring plate 238 is formed near the outer circumference of upper pump plate 220 and a circumferential lower ring plate 238 is formed near the outer circumference of lower pump plate 210. Ring plates 238, 239 are attached to the outer surfaces of pump plates 210, 220 of impeller 200, respectively.

Figure 12:
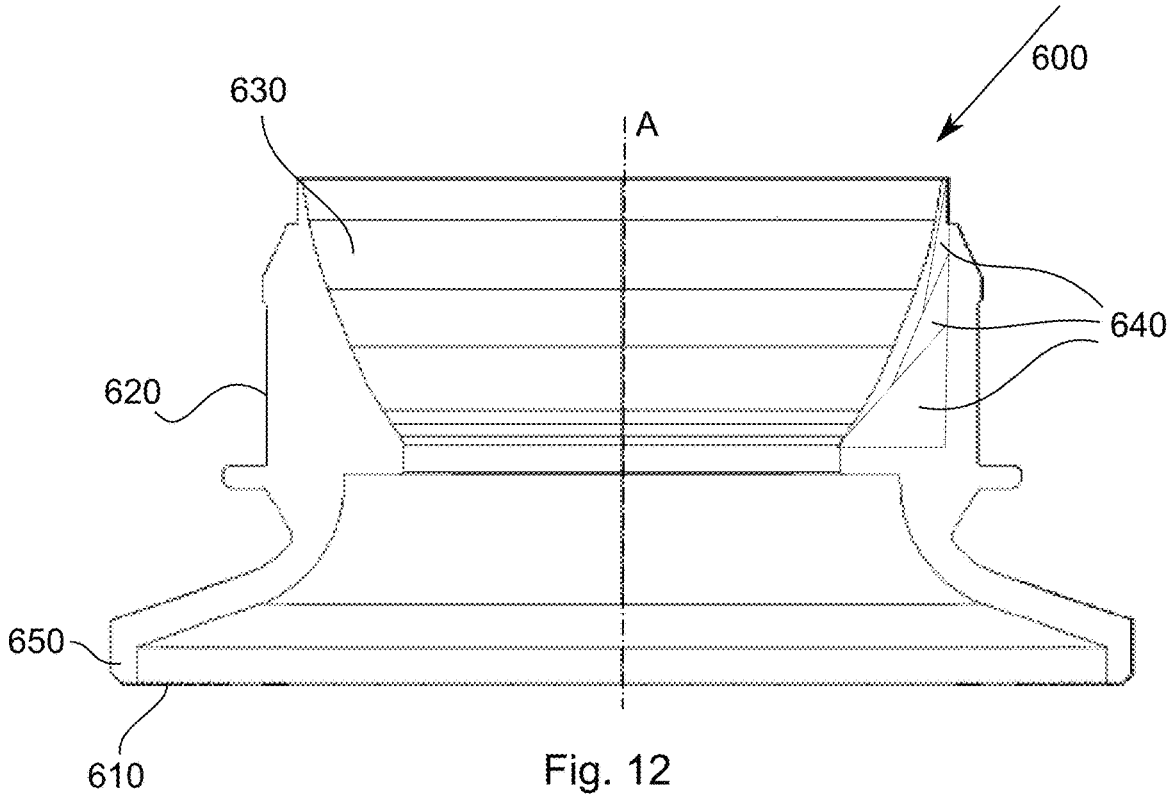
FIG. 12 is a sectional view of a pressure bushing according to a further embodiment of the present invention.

FIG. 12 shows a sectional view of a pressure bushing 600 according to a further embodiment of the present invention. The embodiment of pressure bushing 600 depicted in FIG. 12 mostly corresponds to that shown in FIGS. 10*a* and 10*b* with the exception that bottom portion 610 further comprises a pressure ring 650 attached to the outer circumference of bottom portion 610 of pressure bushing 600.

Figure 13:
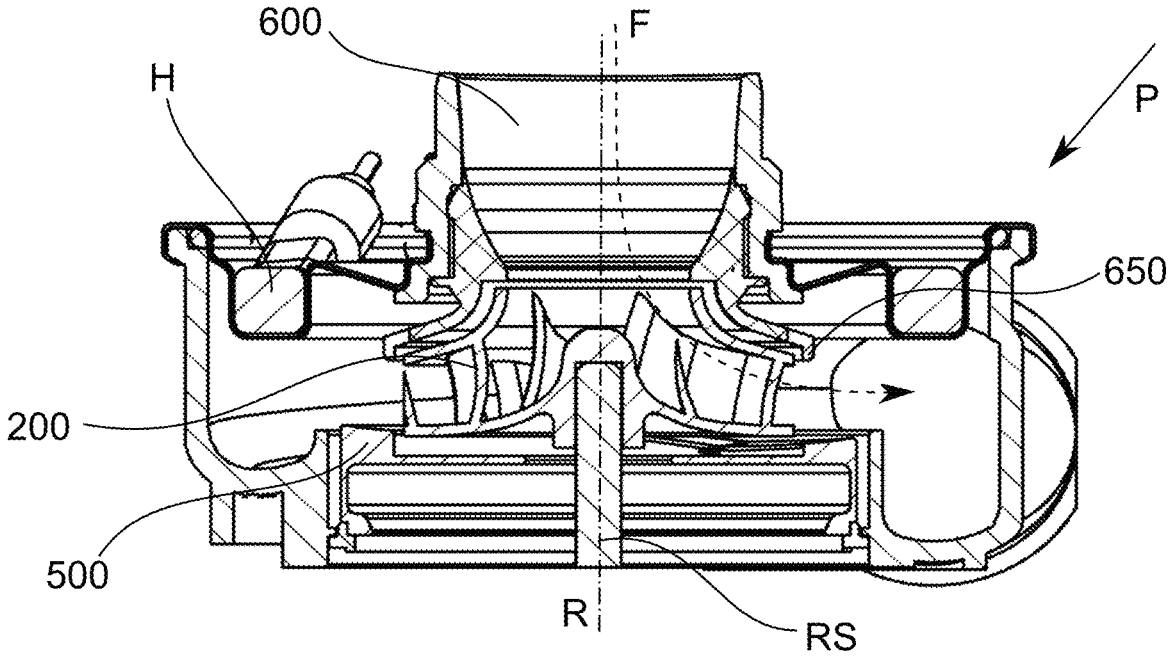
FIG. 13 is a sectional view of a pump according to another embodiment of the present invention including the pressure bushing of FIG. 12.

FIG. 13 depicts a sectional view of a pump P according to another embodiment of the present invention including pressure bushing 600 of FIG. 12. As can be inferred from FIG. 13, pressure ring 650 protrudes over upper pump plate 220 of impeller 200 and thereby reduces the gap between pressure bushing 600 and impeller 200.

REFERENCE SIGNS

10 impeller
20 top plate

30 bottom plate
40 blades
50 sub-blades
100; 200; 300; 400 impeller
110; 210; 310; 410 lower pump plate
112; 212; 312; 412 coupling section
120; 220; 320; 420 upper pump plate
122; 222; 322; 422 central opening
130; 230; 330; 430 blades
131; 231; 331; 431 suction surface
132; 232; 332; 432 pressure surface
133; 233; 333; 433 first longitudinal side edge
134; 234; 334; 434 second longitudinal side edge
135; 235; 335; 435 inflow side edge
136; 236; 336; 436 outflow side edge
137; 237; 337; 437 upper section
138; 238; 338; 438 upper ring plate
139; 239; 339; 439 lower ring plate
140; 240; 340; 440 sub-blades
500 pressure wall
510 top surface
512 inner surface section
514 outer surface section
516 central cylindrical recess
518 inner circumferential edge portion
519 outer circumferential edge portion
520 bottom surface
530 cylindrical side surface
540 central through hole
600 pressure bushing
610 bottom portion
620 outer side portion
630 inner side portion
640 tensile triangles
650 pressure ring
A central axis
F fluid flow direction
H heating unit
P pump
R rotational axis
RS rotor shaft

The invention claimed is:

1. A pump for domestic appliances, comprising:

a pumping chamber including a central axial fluid inlet and a tangential fluid outlet which tangentially extends from an outer annular passage of the pumping chamber, a heating unit for heating the fluid, the heating unit being arranged at an axially upper wall of the pumping chamber, an impeller adapted to convey fluid from the central axial fluid inlet to the outer annular passage of the pumping chamber, the impeller rotating within the pumping chamber, a motor for driving the impeller, and a pressure wall arranged underneath the impeller between the impeller and the motor and adapted to deflect the fluid flowing out of the impeller into the outer annular passage of the pumping chamber towards the heating unit of the pump, the pressure wall the shape of a disc, the disc-shaped pressure wall having a central axis, the pressure wall comprising:

a top surface facing the pumping chamber; and a bottom surface opposing the top surface;

wherein the top surface includes an inner surface section and an outer surface section, wherein the inner surface section extends radially from the central axis and is recessed to form a central recess; and wherein the outer surface section includes an inner circumferential edge portion and an outer circumferential edge portion, wherein the inner circumferential edge portion is located closer to the central axis than the outer circumferential edge portion, and wherein the outer circumferential edge portion is located radially inwardly of the outer annular passage of the pumping chamber and is located higher than the inner circumferential edge portion with respect to a plane perpendicular to the central axis and passing through the inner circumferential edge portion, wherein the outer surface section further has a helical shape extending substantially in the direction of the central axis of the pressure wall.

2. The pump according to claim 1, wherein the pressure wall further comprises a central through hole extending at least substantially along the central axis for bearing the impeller of the pump.

3. The pump pressure wall according to claim 1, wherein the height of the outer surface section measured from the inner circumferential edge portion to the outer circumferential edge portion increases in the direction perpendicular to the central axis of the pressure wall.

4. The pump according to claim 1, wherein the outer surface section is inclined towards the central axis of the pressure wall.

5. The pump according to claim 1, wherein an inclination angle formed between the outer surface section and the plane perpendicular to the central axis is larger than 0° and less than or equal to 30°.

6. The pump according to claim 1, wherein the outer surface section has a concave shape extending substantially around the entire circumference of the outer surface section.

7. The pump according to claim 1, wherein the helical shape extending substantially around the entire circumference of the outer surface section.

8. The pump according to claim 1, wherein the pressure wall is a deep-drawn part.

9. The pump according to claim 1, wherein the pressure wall is made of a corrosion-resistant metal.

10. The pump according to claim 1, wherein the bottom surface is recessed to form a chamber for receiving a rotor of the motor of the pump.

11. The pump according to claim 1, wherein the bottom surface comprises an outer circumferential edge to connect with a casing portion of the pump.

12. The pump according to claim 1, wherein the central recess has a cylindrical shape which substantially matches the outer contour of the impeller.

* * * * *